US011679063B1

(12) United States Patent
Butaud et al.

(10) Patent No.: US 11,679,063 B1
(45) Date of Patent: Jun. 20, 2023

(54) MEDICATION-DISPENSING SYSTEM AND METHOD

(71) Applicant: BUTAUD ENTERPRISES LLC, Vernal, UT (US)

(72) Inventors: Wade M. Butaud, Vernal, UT (US); Benjamin A. Grover, Phoenix, AZ (US); Kent F. Beck, Layton, UT (US); James A. Malmstrom, Kaysville, UT (US); Mitchel Nelson, Bluffdale, UT (US)

(73) Assignee: Pill Smart LLC, Vernal, UT (US)

( * ) Notice: Subject to any disclaimer, the term of this patent is extended or adjusted under 35 U.S.C. 154(b) by 0 days.

(21) Appl. No.: 17/199,431

(22) Filed: Mar. 11, 2021

Related U.S. Application Data

(63) Continuation-in-part of application No. 17/135,773, filed on Dec. 28, 2020, now abandoned, which is a continuation of application No. 16/280,000, filed on Feb. 19, 2019, now Pat. No. 10,874,590.

(60) Provisional application No. 62/632,412, filed on Feb. 19, 2018.

(51) Int. Cl.

| | |
|---|---|
| ***A61J 1/03*** | (2023.01) |
| ***A61J 7/00*** | (2006.01) |
| ***A61J 7/04*** | (2006.01) |

(52) U.S. Cl.
CPC ..... *A61J 7/0076* (2013.01); *A61J 1/03* (2013.01); *A61J 7/0436* (2015.05); *A61J 2200/30* (2013.01)

(58) Field of Classification Search
CPC ..... A61J 7/0076; A61J 1/03
See application file for complete search history.

(56) References Cited

U.S. PATENT DOCUMENTS

| | | | | |
|---|---|---|---|---|
| 4,460,106 | A | 7/1984 | Moulding, Jr. et al. | |
| 5,852,590 | A | 12/1998 | De La Huerga | |
| 6,302,295 | B1 | 10/2001 | Weisman | |
| 6,545,592 | B2 | 4/2003 | Weiner | |
| 7,907,477 | B2 | 3/2011 | Puzia | |
| 7,978,564 | B2 | 7/2011 | De La Huerga | |
| 9,730,860 | B2 | 8/2017 | Hamilton | |
| 10,874,590 | B1 | 12/2020 | Butaud et al. | |
| 2005/0269348 | A1 | 12/2005 | Limback et al. | |
| 2013/0116818 | A1 | 5/2013 | Hamilton | |
| 2013/0200033 | A1 | 8/2013 | Zonana et al. | |
| 2014/0074283 | A1 | 3/2014 | Blackburn | |
| 2019/0130078 | A1 | 5/2019 | Herbert et al. | |
| 2020/0253829 | A1* | 8/2020 | Mogul | A61J 7/0076 |

* cited by examiner

*Primary Examiner* — Gene O Crawford
*Assistant Examiner* — Ayodeji T Ojofeitimi
(74) *Attorney, Agent, or Firm* — Young Basile Hanlon & MacFarlane, P.C.

(57) ABSTRACT

A system for dispensing a prescription medication in a controlled manner is disclosed. The system may include a prescription vial and a corresponding programmable cap. The cap may include an outer cover having an exit aperture, an inner cover having an entrance aperture, and a transport portion having a chute. The cap may also include a control system having a processor. In accordance with a schedule prescribed by a medical professional and programmed into the control system, the control system may dispense medication by moving the chute of the transport portion out of alignment with the entrance aperture and into alignment with the exit aperture.

20 Claims, 39 Drawing Sheets

MEDICATION-DISPENSING SYSTEM AND METHOD

RELATED APPLICATIONS

This application is a continuation-in-part of U.S. patent application Ser. No. 17/135,773 filed Dec. 28, 2020, which is a continuation of U.S. patent application Ser. No. 16/280,000 filed Feb. 19, 2019 (now U.S. Pat. No. 10,874,590), which claims the benefit of U.S. Provisional Patent Application Ser. No. 62/632,412 filed Feb. 19, 2018.

U.S. patent application Ser. No. 17/135,773, U.S. patent application Ser. No. 16/280,000, and U.S. Provisional Patent Application Ser. No. 62/632,412 are each hereby incorporated by reference.

BACKGROUND

Field of the Invention

This invention relates to controlling access to prescription medication and, more particularly, to novel systems and methods for dispensing medication according to predefined schedules.

Background Art

Modern medicine has produced many different medications. While these medications accomplish significant good, some are potentially addictive, have negative side effects, or simply need to be limited in their use. For example, in the past century, our society has seen an increased use of medications for pain, anxiety, sleep, etc. Some patients misuse or abuse these medications in attempts to obtain a euphoric effect or to profit by selling their medication to others who would abuse or misuse that medication.

There have been efforts to ensure that the use of the medication is exactly as prescribed without the risk of abuse or misuse. Despite these efforts, a 2008 report by the Coalition Against Insurance Fraud estimates that the abuse of opioid analgesics alone results in more than $72 billion in medical costs each year. This figure does not account for all of the other types of controlled substances such as benzodiazepines and stimulants, which, if included, may result in more than $100 billion per year in medical costs. Accordingly, what is needed are improved systems and methods for controlling access to prescription medication.

BRIEF DESCRIPTION OF THE DRAWINGS

The foregoing features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF SELECTED EMBODIMENTS

Figure 1:
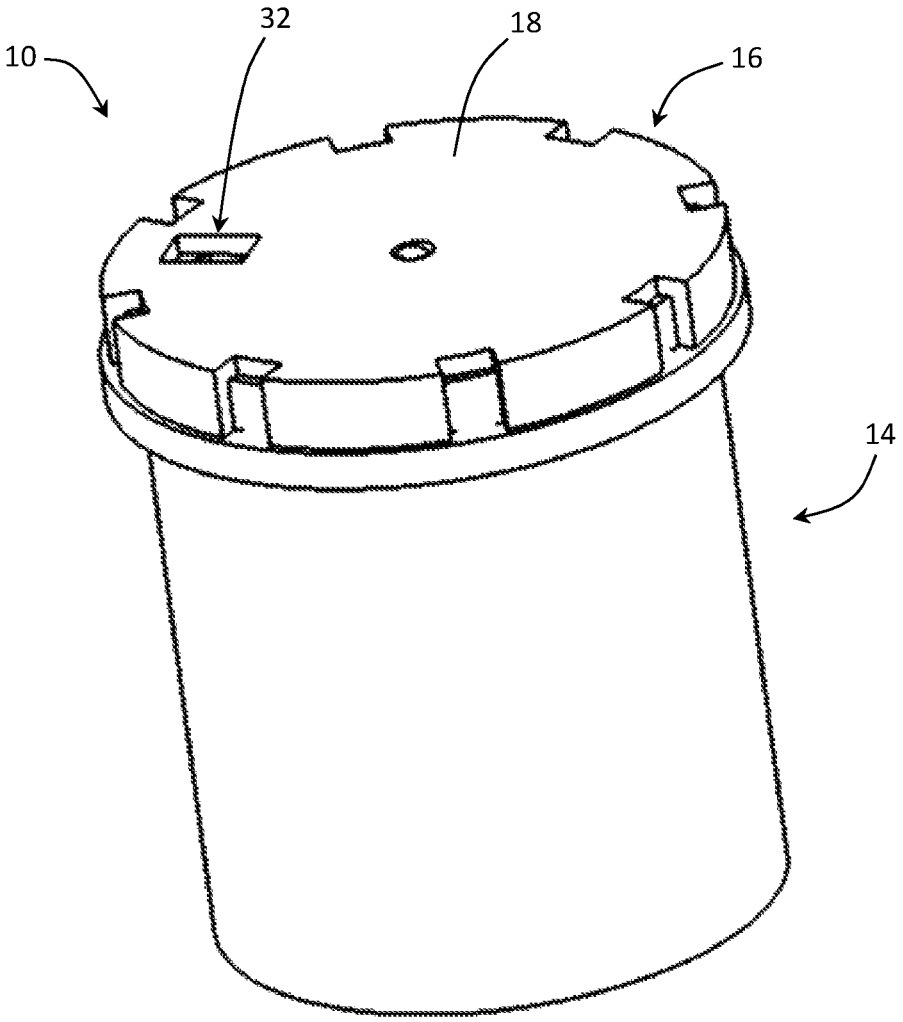
FIG. 1 is a perspective view of one embodiment of a system in accordance with the present invention.
Figure 2:
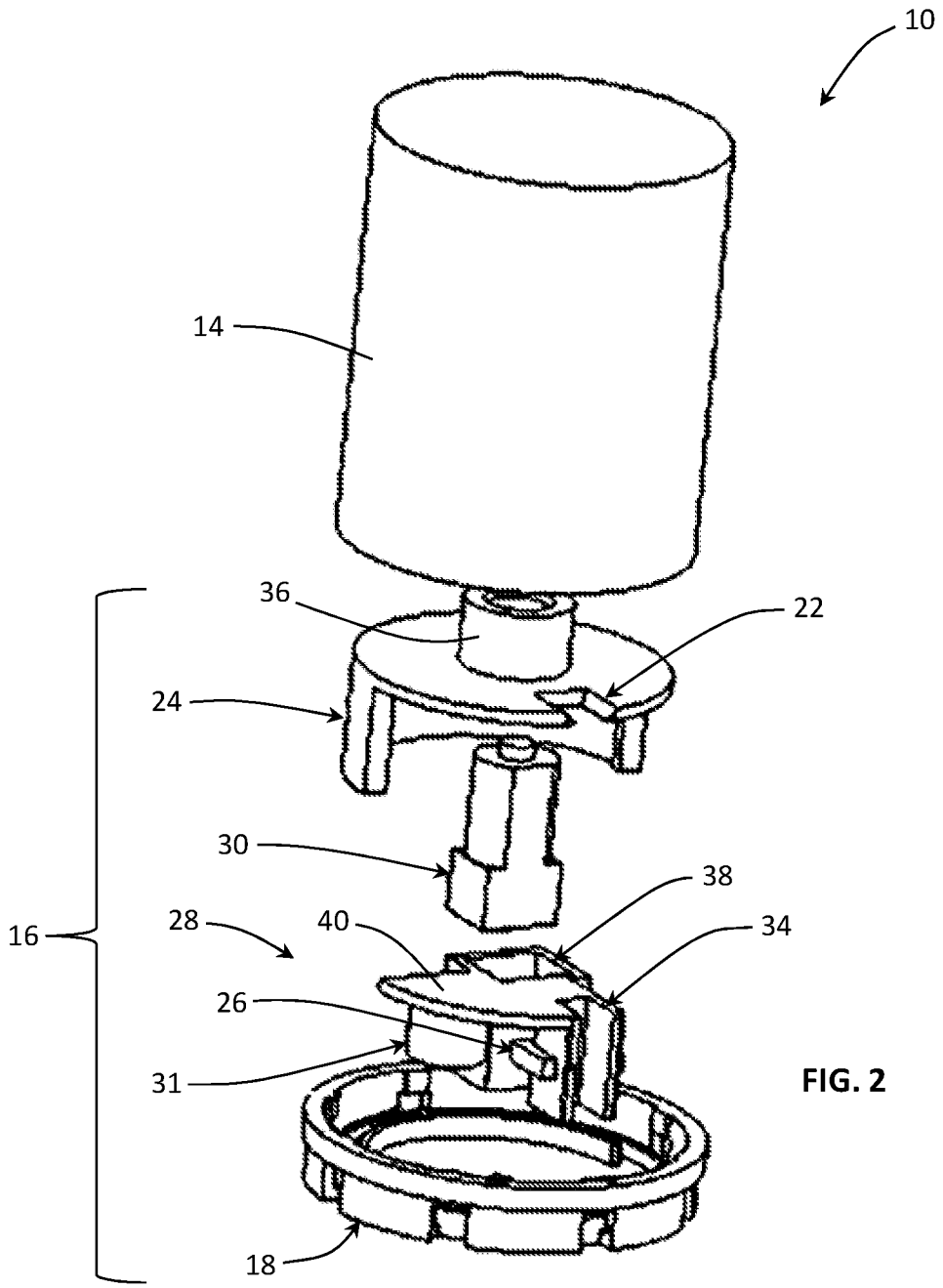
FIG. 2 is an exploded perspective view of the system of FIG. 1.
Figure 3:
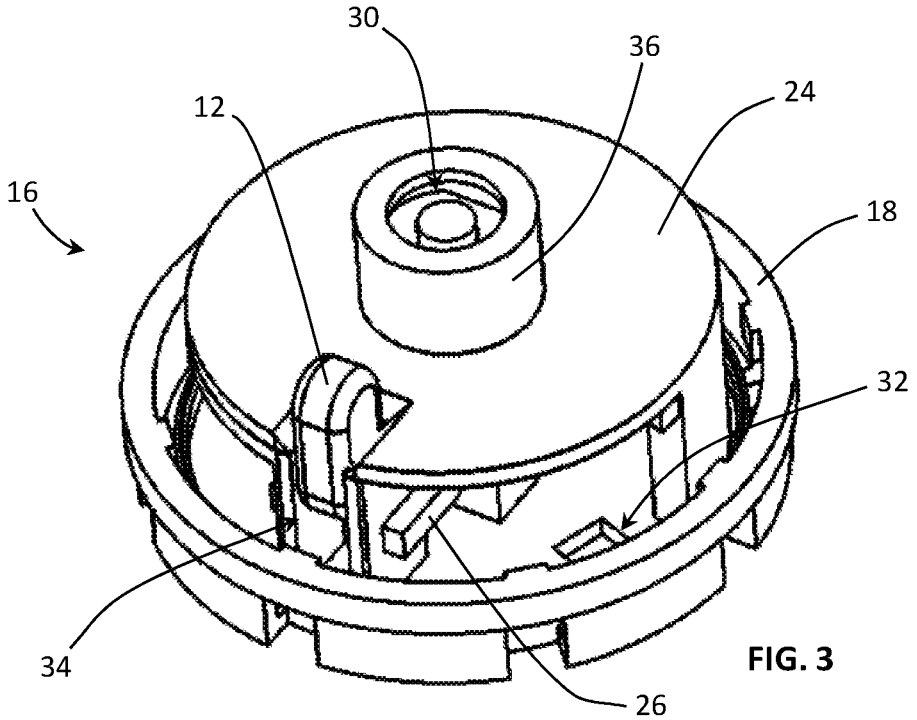
FIG. 3 is a perspective view of the cap of the system of FIG. 1 with the cap in a load position and a quantity of medication entering a chute of a transport portion of the cap.
Figure 4:
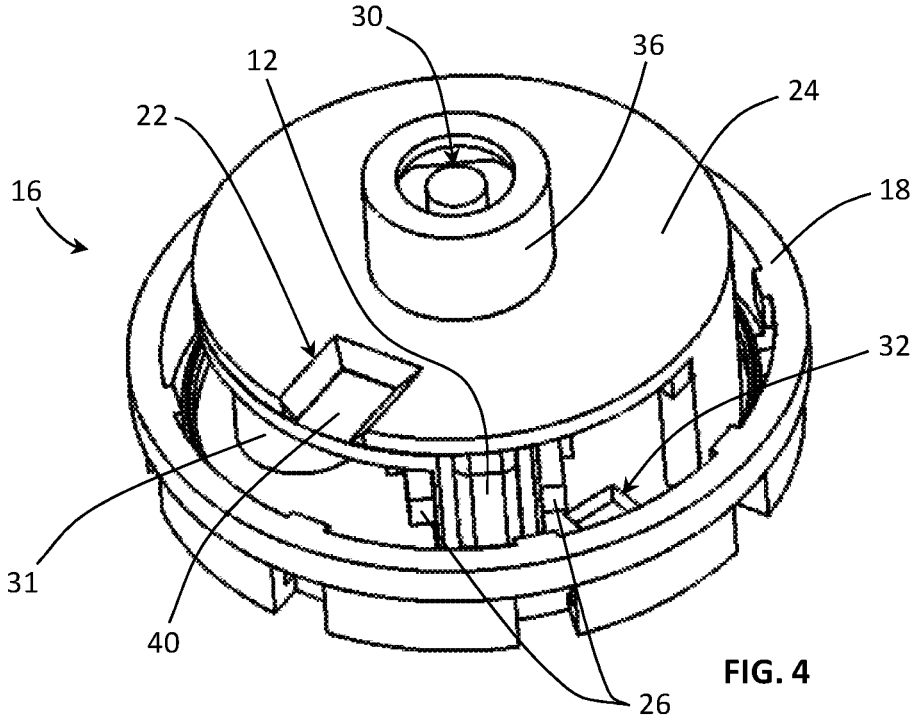
FIG. 4 is a perspective view of the cap of the system of FIG. 1 with the cap in an intermediate position and a quantity of medication contained within a chute of a transport portion of the cap.

It will be readily understood that the components of the present invention, as generally described and illustrated in the drawings herein, could be arranged and designed in a wide variety of different configurations. Thus, the following more detailed description of the embodiments of the system and method of the present invention, as represented in the drawings, is not intended to limit the scope of the invention, as claimed, but is merely representative of various embodiments of the invention. The illustrated embodiments of the invention will be best understood by reference to the drawings, wherein like parts are designated by like numerals throughout.

Referring to FIGS. 1-9, in selected embodiments, a system 10 in accordance with the present invention may allow a physician to prescribe a medication 12 with less concern or risk that misuse of the medication 12 will go undetected. A medication 12 may be any substance that has a reported benefit when incorporated into or onto the body of a patient by any one or more routes such as oral, rectal, intravenous, transdermal, intranasal, etc. Medication 12 may be provided in various forms including as a pill, tablet, dissolvable film, capsule, or the like.

In general, controlled or prescription medication 12 may be medication 12 whose manufacture, distribution, possession, or use is regulated by a government entity. Such medication 12 may also, in some instances, include those that have abuse or misuse potential and/or those for which control over distribution to a patient is desired by a prescriber.

Misuse is use of a medication 12 for something for which it was not intended. A non-limiting example may be use contrary to instructions provided by a medical professional (e.g., contrary to a prescription corresponding to the medication 12). Another non-limiting example may be using a medication 12 for a headache when the medication 12 was prescribed for pain relief (e.g., pain related to a broken arm, removal of wisdom teeth, etc.). Still another non-limiting example may be taking multiple doses of an opioid pain medication 12 without waiting the proper time period between the doses, taking a dose at the wrong time, forgetting to take a dose, and unilaterally deciding to stop taking a medication 12.

Abuse may include a patterned use of one or more medications 12 in which the user consumes the substance in amounts and/or with methods which are harmful physically, socially, psychologically, or the like to himself or herself or others. Abuse may be a form of substance-related disorder. Abuse may include use of a substance to obtain a euphoric effect and/or to avoid withdrawal symptoms.

A system 10 may enable a pharmacy or the like to quickly and easily dispense a medication 12 without granting the patient access to all the medication 12 at one time. The patient may be limited in using the medication 12 to the frequency and dosage set by a physician (e.g., the frequency and dosage set forth in a prescription). A system 10 may be abuse deterrent and tamper proof and provide a way for the prescribing institutions to know if the medication 12 was dispensed as prescribed.

A system 10 in accordance with the present invention may selectively dispense medication 12. In some instances, a system 10 may dispense from a standard and/or specially designed medication bottle 14. A system 10 may be small, convenient, inexpensive, lockable from the pharmacy, misuse deterrent, and straightforward. A system 10 may reduce the overall costs associated with prescription medication abuse and misuse, reduce the number of overdoses, and save lives.

A system 10 may not require complex machinery. In certain embodiments, a system 10 may comprise a cap 16 that fits onto and securely engages a container 14. A container 14 may be a pill bottle, a pill box, or some other container capable of containing medication 12. In general, a container 14 may have a volume in a range from about 30 milliliters to about 175 milliliters. However, containers 14 of a lesser or greater volume may be used in certain embodiments.

In selected embodiments, a container 14 may be a standard pill bottle of a standard size that is routinely dispensed at a pharmacy (e.g., a standard plastic prescription vial or bottle). In certain embodiments, a cap 16 may not increase or may not significantly increase the size of such a container 14. That is, a cover or exterior portion 18 of a cap 16 in accordance with the present invention may have exterior dimensions that are comparable to those of a standard cap for such a container 14. In selected embodiments, this may be accomplished by positioning the various mechanisms of a cap 16 on an underside thereof so that they are positioned within the container 14 when the cap 16 is applied thereto. Accordingly, a system 10 may be compact and readily portable.

A cap 16 may engage a container 14 in a manner that prevents any unauthorized person from removing the cap 16 from the container 14. For example, in selected embodiments, an outer cover 18 of a cap 16 may include a plurality of lugs 20 that mechanically engage and/or securely lock with a container 14. In certain embodiments, the engagement between a cap 16 and a corresponding container 14 may be such that a special tool may be required to separate the two. Accordingly, by controlling access to that special tool, removal of a cap 16 from a container 14 may be controlled.

Alternatively, an engagement between a cap 16 and a corresponding container 14 may be such that destruction of the container 14 is required to separate the two. For example, once a medication 12 has been placed within a container 14 and a cap 16 has been applied, it may be mechanically impossible to separate the two without irreparably damaging one or the other. In selected embodiments, a container 14 may be the less expensive of the two. Accordingly, when a refill of a medication 12 is needed, a pharmacy may destroy the container 14 in order to free the cap 16. The cap 16 may then be applied to another container 14 into which an appropriate quantity of the medication 12 (e.g., a prescription refill) has been placed.

In certain embodiments, a cap 16 in accordance with the present invention may contain a controller (e.g., a control system) programmed or otherwise constructed to control when medication 12 is permitted to pass through the cap 16. Accordingly, a controller may be a gate keeper that controls the flow or movement of medication 12 from inside a system 10, through a cap 16, to a location outside of the system 10 where the medication 12 is accessible to a patient.

A controller may be programmed or otherwise constructed to permit a predefined amount of medication 12 to pass through a cap 16 on a predefined schedule. The predefined amount and the predefined schedule may be selected, defined, redefined, programmed in, set, updated, or the like exclusively by a medical professional who prescribes the medication, a medical professional who fills the prescription, or some other authorized person having the special tools, access codes, communication devices, or the like that are required to do the job. Thus, the amount of medication 12 that is dispensed and the timing of that dispensing may be within the control of authorized persons and outside the control of unauthorized persons (e.g., the patient).

The predefined amount of medication 12 may be the number of pills prescribed as a single dose. Accordingly, the predefined amount of medication 12 may be 1, 2, 3, 4, 5, or 6 pills or greater. In selected embodiments, the predefined amount of medication 12, the predefined schedule, or both may be adjusted automatically and/or on the fly by a controller acting autonomously or as instructed by a supervising computer. In certain embodiments, the predefined amount of medication 12 may vary by the time of day, by the number of times the system 10 dispenses medication 12, with the passage of time (e.g., decreasing with the passage of time), or the like. By controlling how much and when medication 12 is dispensed, a system 10 may prevent and/or reveal an impulsive overdose, an attempt to sell the medication 12 in large quantities, or other unwanted behavior.

In selected embodiments, an entrance gate 22 or aperture 22 of a cap 16 may be changed to accommodate a range of medications 12. That is, an entrance gate 22 suitable for admitting one pill corresponding to a first medication 12 may be too big or too small to admit one pill corresponding to a second medication 12. Thus, by swapping intake gates 22 (or an inner cover 24 having an entrance gate 22 or aperture 22 formed therein), a cap 16 may be quickly and inexpensively adapted to handle medications 12 of various types.

Alternatively, different caps 16 may be used for different medications 12. Accordingly, in situations where changing an entrance gate 22 or inner cover 24 may be insufficient to accommodate a particular medication 12, a different cap 16 that is better sized to accommodate the particular medication 12 may be selected. Thus, by properly selecting from among a variety of entrance gates 22, inner covers 24, and/or a variety of caps 16, a system 10 suitable for most if not all prescription medications 14 may be obtained.

In certain embodiments, one or more sensors 26 (e.g., electronic sensors such as optical sensors, limit sensors or switches, accelerometers, or the like) forming part of a cap 16 may detect when and how much medication 12 is dispensed, whether a system 10 has dispensed medication 12, whether an attempt (e.g., an improper attempt) has been made to access the medication 12, whether a cap 16 has been damaged, whether a container 14 has been damaged, whether a transport portion 28 of a cap 16 has reached an end to its range of motion, or the like. Data or other signals or outputs from such components 26 may be used by a controller in determining how to act (e.g., when and/or how much medication 12 to dispense). Alternatively, or in addition thereto, data or other signals or outputs from such components 26 may be communicated to other devices (e.g., remote computing devices).

For example, data output by or corresponding to such sensors 26 may be passed (e.g., via wireless communication) to a computing device (e.g., a tablet or smart phone of a patient or medical professional) that is connected to the Internet. This may make such data available for inspection by medical professionals, computer programs programmed to detect improper behavior with respect to prescription medication 12, or the like. Accordingly, various kinds of improper behavior (e.g., discrepancies between the number of pills available and numbers reported by a system 10) may be detected and used to curb abuse, limit misuse, and get those that are having difficulties the help that they need.

In selected embodiments, a cap 16 may include an outer cover 18, an inner cover 24, one or more sensors 26 or switches 26, a transport portion 28, a control system comprising or controlling the operation of an actuator 30, one or more batteries 31 providing electrical power to a control system, or the like or a combination or sub-combination thereof. An outer cover 18 may combine with a container 14 to define the exterior of a system 10 in accordance with the present invention. An outer cover 18 may include the structures necessary to mechanically engage and/or securely lock with a container 14. An outer cover 18 may have an exit aperture 32 through which dispensed medication 12 may exit a system 10.

An inner cover 24 may connect to an underside of an outer cover 18. A space between an inner cover 24 and an outer cover 18 may be occupied by a transport portion 28 and one or more components (e.g., one or more sensors 26 or switches 26, an actuator 30, a controller, or a combination or sub-combination thereof) that are connected to and move (e.g., rotate) with the transport portion 28.

An entrance gate 22 or aperture 22 in an inner cover 24 may be axially misaligned with an exit aperture 32 in an outer cover 18. In operation, a transport portion 28 may selectively move between a first location (e.g., a load position) corresponding to an alignment with an entrance aperture 22 and a second location (e.g., an unload position) corresponding to an alignment with an exit aperture 32. Thus, a transport portion 28 may transport medication 12 from an entrance aperture 22 to an exit aperture 32.

For example, in selected embodiments, a transport portion 28 may have or define a chute 34 shaped and sized to receive medication 12 (e.g., one or more pills, tablets, capsules, or the like). When the transport portion 28 is in the first location, the chute 34 may be axially aligned with an entrance gate 22 or aperture 22. Accordingly, medication 12 contained within a system 10 (e.g., within a container 14) may move (e.g., fall) through the entrance gate 22 and into the chute 34. The transport portion 28 may then be moved (e.g., rotated) to the second location. In the second location, the chute 34 may be axially aligned with an exit aperture 32. Accordingly, medication 12 may move (e.g., fall) out of the chute 34 through the exit aperture 32. In this manner, medication 12 may pass from a location within a system 10 to a location outside of a system 10.

In selected embodiments, a control system comprising an actuator 30 may control movement of a transport portion 28. In certain embodiments, an actuator 30 may comprise an electrical motor (e.g., a servomotor or stepper motor), linear actuator, or the like. An actuator 30 may induce relative rotation between a transport portion 28 and the outer and inner covers 18, 24, which two covers 18, 24 may be fixed with respect to one another.

As shown in the illustrated embodiment, an inner cover 24 may include a first actuator mount 36 configured to engage a first portion of an actuator 30, while a transport portion 28 may include a second actuator mount 38 configured to engage a second portion of the actuator 30. Accordingly, when an actuator 30 effects movement (e.g., rotation) between the first and second portions thereof, the actuator 30 may produce relative movement (e.g., rotation) between a transport portion 28 and an inner cover 24.

In selected embodiments, a transport portion 28 may include a blocking flange 40. A blocking flange 40 may block medication 12 from exiting a container 14 via an entrance aperture 22 whenever a chute 34 is not aligned with the entrance aperture 22. For example, a transport portion 28 may be configured so that when a chute 34 rotates out of alignment with an entrance aperture 22, a blocking flange 40, or some portion thereof, may rotate into alignment with the entrance aperture 22.

In certain embodiments, an actuator 30 and/or other components of a cap 16 in accordance with the present invention may require electrical power to operate. Accordingly, a cap 16 may include one or more batteries 31. For example, one or more batteries 31 may be mounted to and move with a transport portion 28.

A controller may be mounted to and move with a transport portion 28. In selected embodiments, a controller may control the flow of electricity from a battery 31 to an actuator 30 based on data or other outputs from one or more sensors 26 switches 26 or the like. For example, in certain embodiments, when medication 12 falls through an entrance gate 22 or aperture 22 and into a chute 34, one or more sensors 26 (e.g., an optical sensor) may detect the presence of the medication 12. Knowing that the chute 34 is loaded with medication 12, a controller may determine whether it would be appropriate to dispense the medication 12. If it is not the right time to dispense medication 12, the controller may do nothing. Conversely, if it is the right time to dispense medication 12, the controller may activate an actuator 30 and induce rotation of a transport portion 28.

Figure 5:
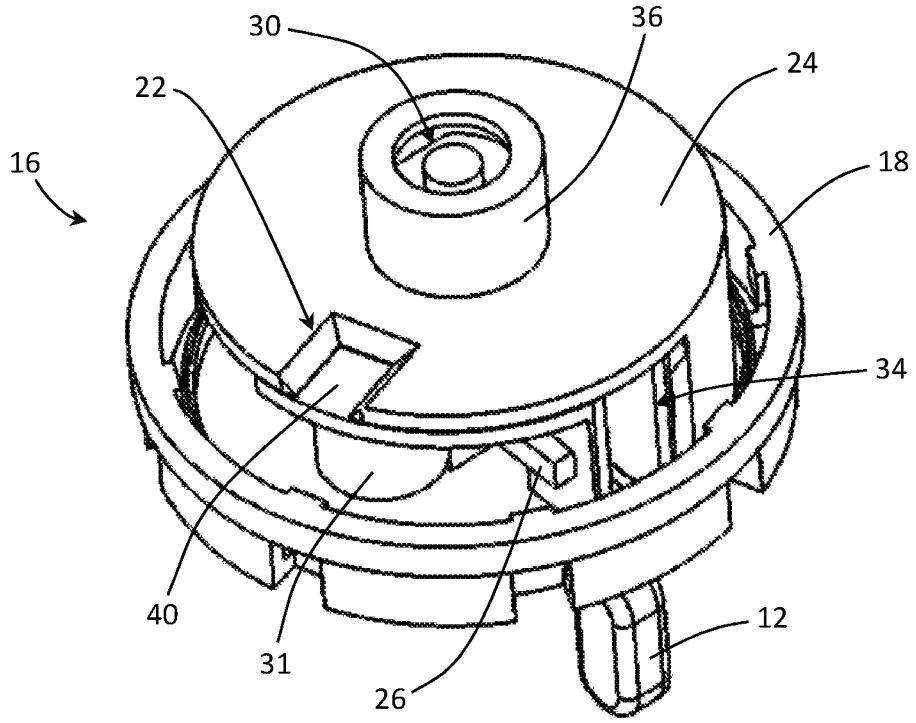
FIG. 5 is a perspective view of the cap of the system of FIG. 1 with the cap in an unload position and a quantity of medication exiting a chute of a transport portion of the cap.
Figure 6:
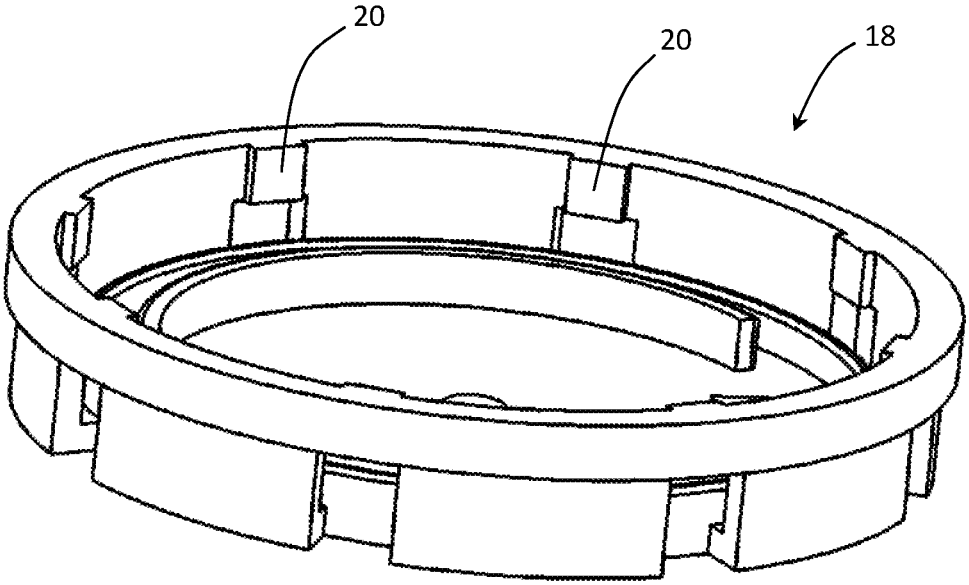
FIG. 6 is a perspective view of an outer cover of the cap of the system of FIG. 1.
Figure 7:
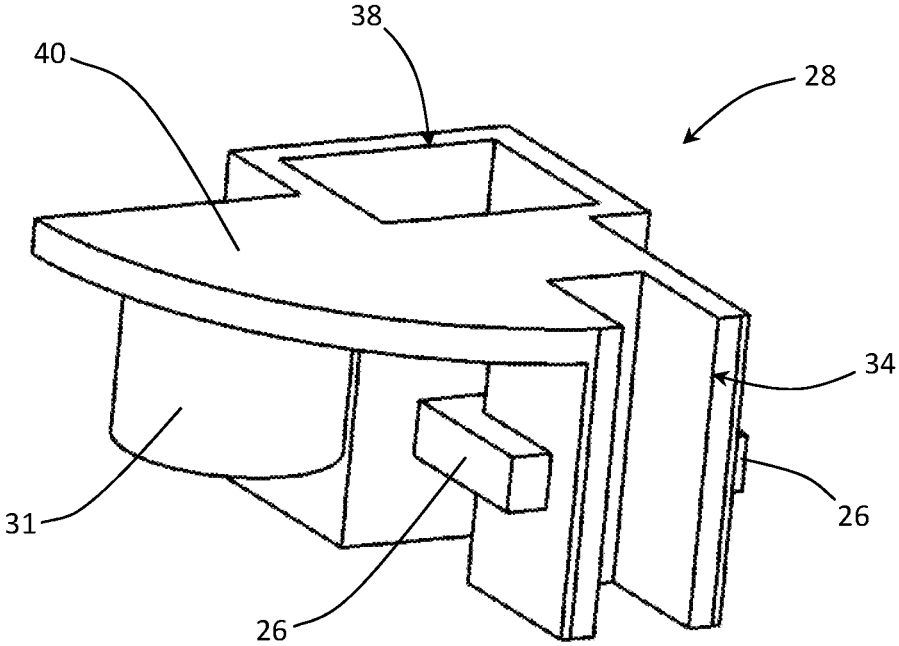
FIG. 7 is a perspective view of a transport portion of the cap of the system of FIG. 1.
Figure 8:
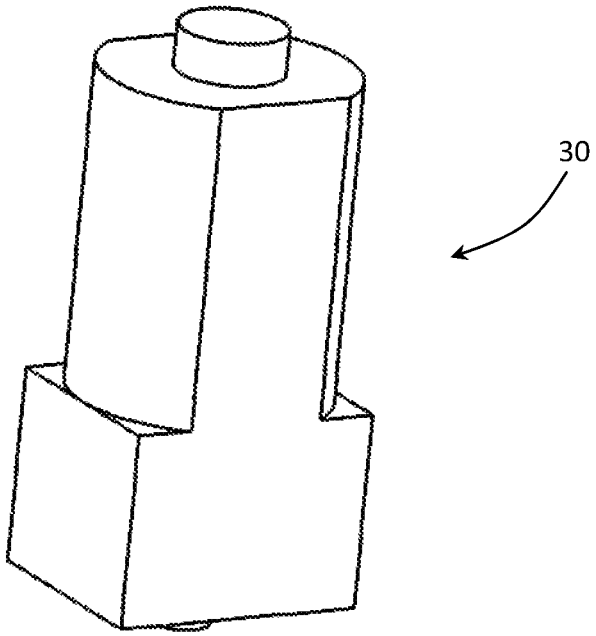
FIG. 8 is a perspective view of an actuator of the cap of the system of FIG. 1.
Figure 9:
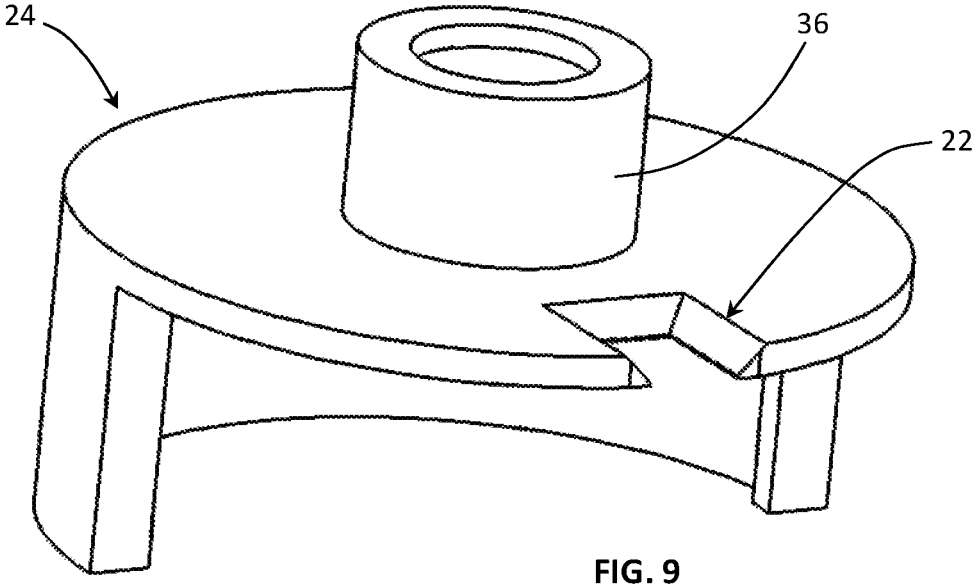
FIG. 9 is a perspective view of an inner cover of the cap of the system of FIG. 1.

In selected embodiments, this rotation may move the transport portion 28 to a second location as shown in FIG. 5. Thus, a chute 34 may move out of alignment with an entrance gate 22 and into alignment with an exit aperture 32. In the second location, the medication 12 may fall out of the chute 34 through the exit aperture 32. When medication 12 falls though an exit aperture 32, one or more sensors 26 (e.g., an optical sensor) may detect the absence of the medication 12. Knowing that the chute 34 is now empty, a controller may determine that it would be appropriate to return the transport portion 28 to the first location. In this manner, a cap 16 may be at rest and the process may be repeated until the medication 12 contained within the system 10 has all been dispensed according to (no sooner or quicker then set forth in) the predetermined schedule.

Accordingly, a system 10 may dispense a medication 12 from a pill bottle 14 or other container 14 by allowing only a limited number of dispensings in a predetermined amount of time. The system 10 may comprise a cap 16 permanently locked onto the pill bottle 14 or other container 14 using a locking mechanism releasable only by the pharmacist, and not by the patient. This may prevent the patient from accessing more medication 12 than allotted in a specific amount of time. Accordingly, the risk of a patient taking more medication 12 than prescribed, giving medication 12 to others, or selling medication 12 to others may be significantly reduced.

Alternatively, or in addition thereto, if a patient tampers with a system 10 in order to take more medication 12 than prescribed, give medication 12 to others, sell medication 12 to others, etc., that misuse may be reported by the system 10, revealed by the condition of the system 10 when it is returned to a pharmacy (which return may be required to obtain a refill), or the like. Thus, misuse of a medication 12 may be prevented or revealed as early as possible so that it may be addressed appropriately.

A cap 16 may comprise an electronic and mechanical coupling device. The electronic portion may be able to detect and determine when a medication 12 has been dispensed. If the appropriate amount of time has not elapsed, a cap 16 may not let a transport portion 28 rotate and dispense a medication 12.

A transport portion 28 of a cap 16 may be controlled electronically and automatically using a controller, battery 31, actuator 30, and/or the like or it may be manually rotated by the user depending on the design of the particular model. Thus, in selected embodiments, the electronic portions of a cap 16 may unlock or otherwise free a transport portion 28 to rotate, but may not provide that rotation (i.e., the electronics may control the lock according to a predefined schedule and the human user may provide the rotation once the transport portion 28 has been unlocked). Accordingly, when electrical power must be conserved to provide a desired service life, a hybrid system with partial electronic and partial manual actuations may be used.

An entrance gate 22 or aperture 22 or a structure (e.g., inner cover 24) providing the same may be variable or replaceable. Accordingly, the size of an entrance gate 22 or aperture 22 may be changed as needed to accommodate many different sizes of medication 12. The height of a cap 16, inner cover 24, transport portion 28, chute 34, or the like or a combination or sub-combination thereof may also be variable to accommodate different sizes of medication 12, provide additional space for a larger battery 31 or set of batteries 31, provide additional space for a larger and/or stronger actuator 30, or the like.

The electronic portion of a system 10 may incorporate a reporting mechanism that may communicate and/or sync via WIFI, BLUETOOTH, or the like with a computing device of a patient, pharmacist, or the like so that usage data may be available to those that may need to see it. There may be both an electronic anti-tamper and a mechanical anti-tamper mechanism that can also be reported. These types of usage statistics may be used by prescribers to determine if the patient will be eligible for medication refills or if they are to be deemed too high risk for a refill of a controlled medication 12.

One challenge to controlling abuse and misuse is that it has been difficult to share and/or access prescription histories for patients. A patient may cross a state border to fill a different prescription and one physician may not have access to the other state's controlled substance database. Prior to prescribing, it is expected that a provider evaluate the prescription history. However, due to the time limits placed on providers, it frequently does not happen.

Accordingly, in selected embodiments, a plurality of systems 10 may be used in conjunction with a central, interstate website. Such a website may contain data on all prescription histories, times, dates, locations, prescription providers, or the like in order to prevent cross-border doctor shopping. Electronic prescribing through such a website may also mandate that physicians review the controlled substance use history of their patients.

The development of this central website, combined with mandated physician review, and the reportable medication use, misuse, or abuse provided by one or more systems 10 may significantly reduce the cost of medication abuse, misuse, and their related deaths.

Figure 10:
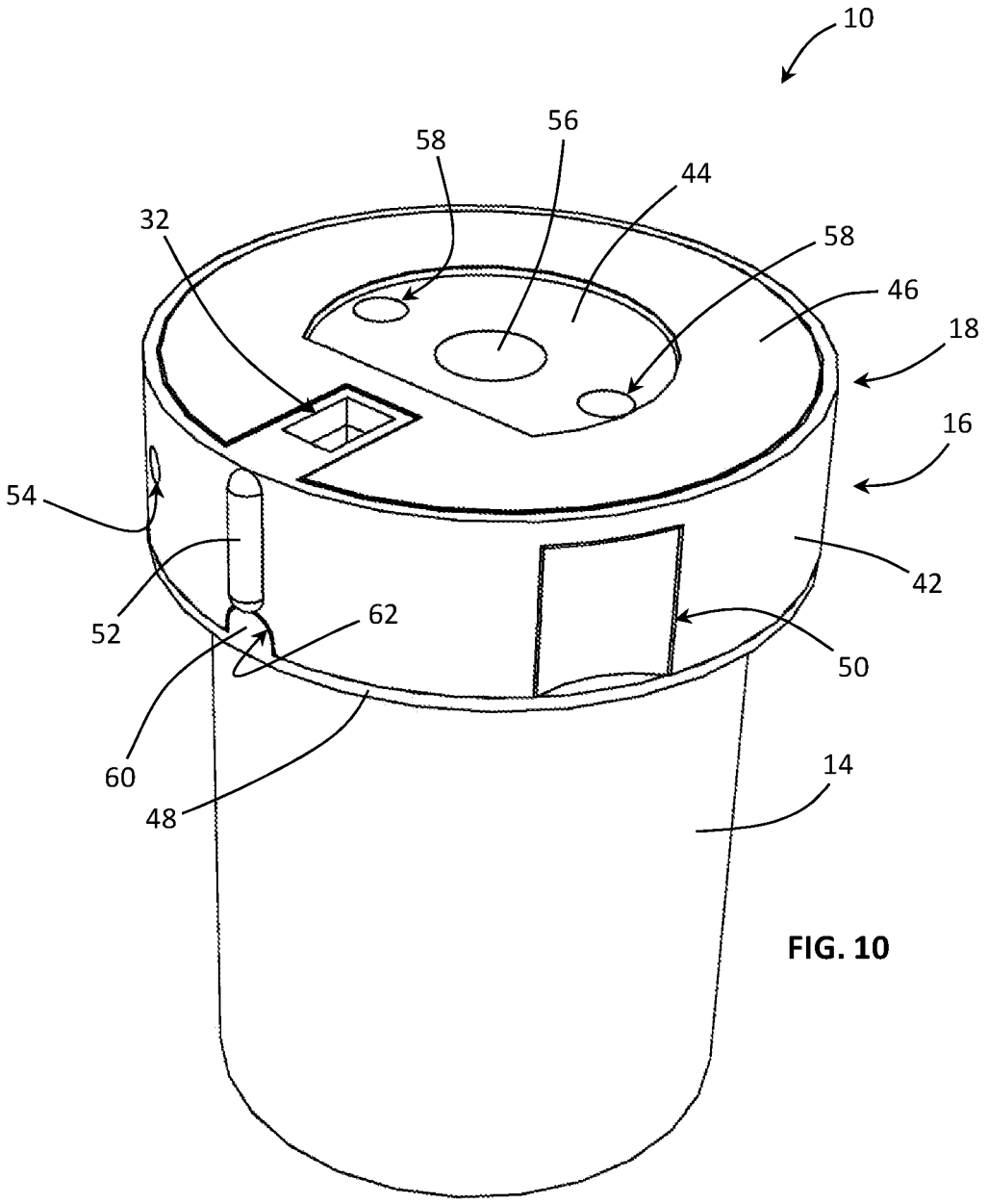
FIG. 10 is a perspective view of an alternative embodiment of a system in accordance with the present invention.
Figure 11:
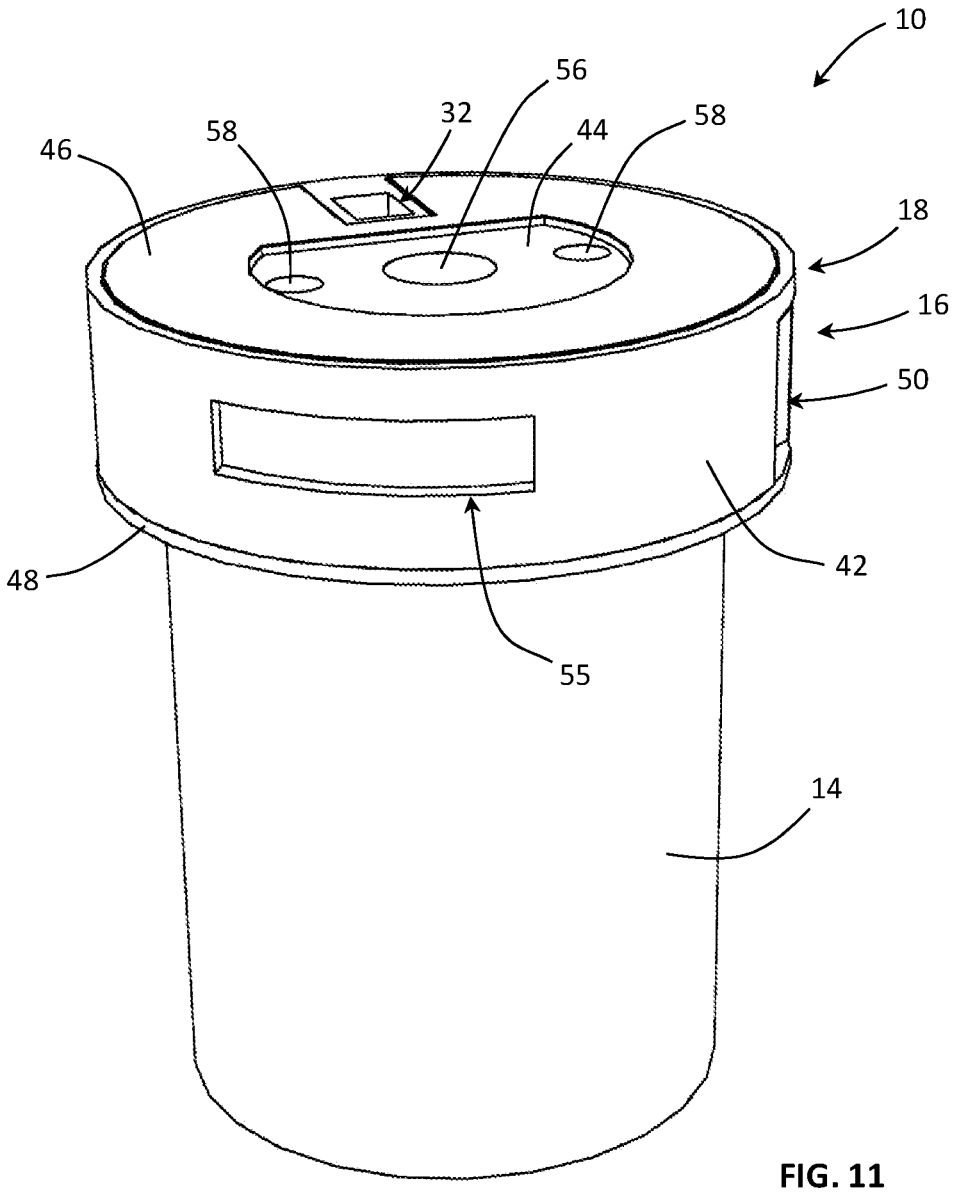
FIG. 11 is another perspective view of the system of FIG. 10.
Figure 12:
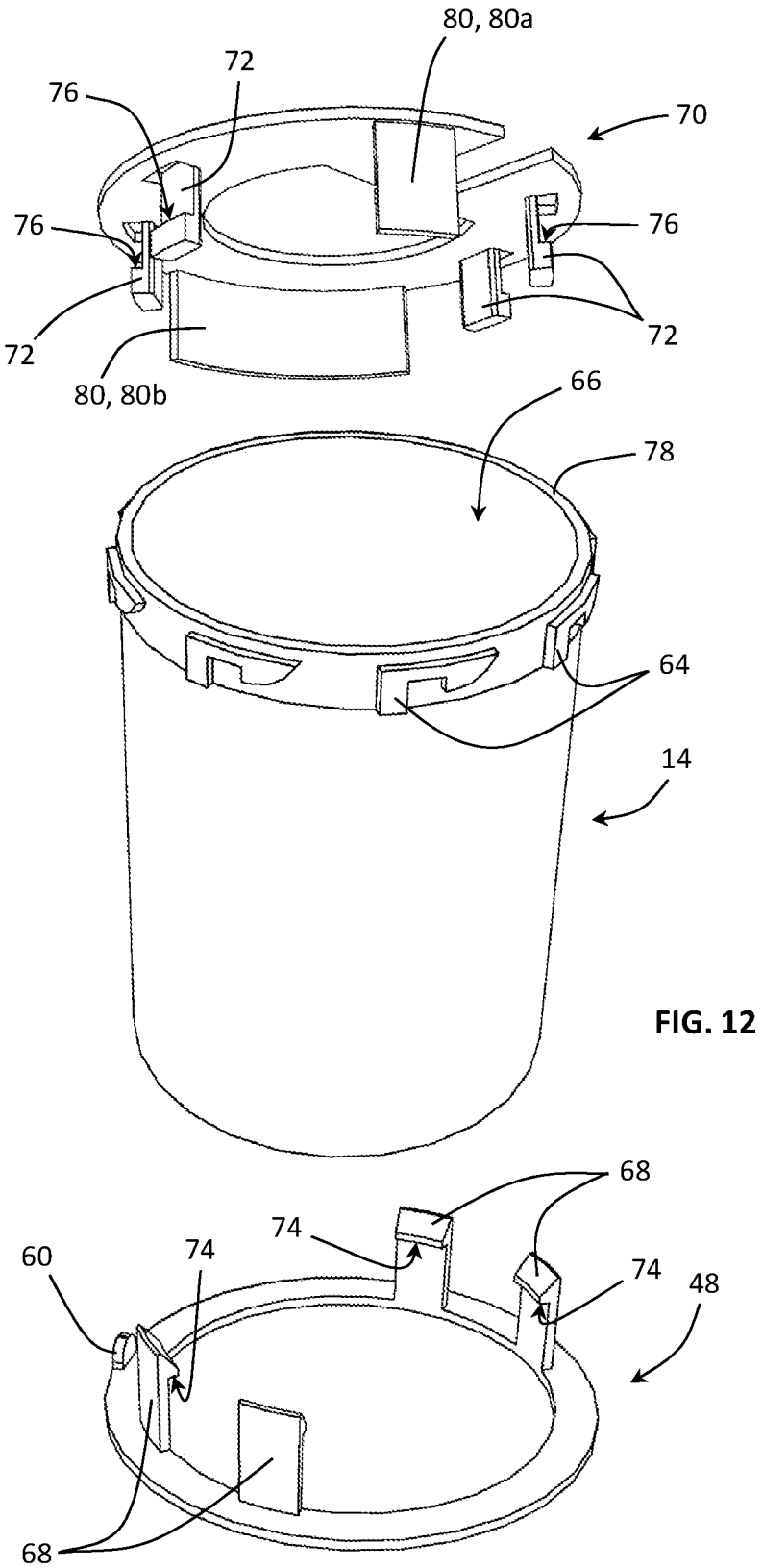
FIG. 12 is an exploded perspective view of an upper locking ring, container, and lower locking ring of the system of FIG. 10.
Figure 13:
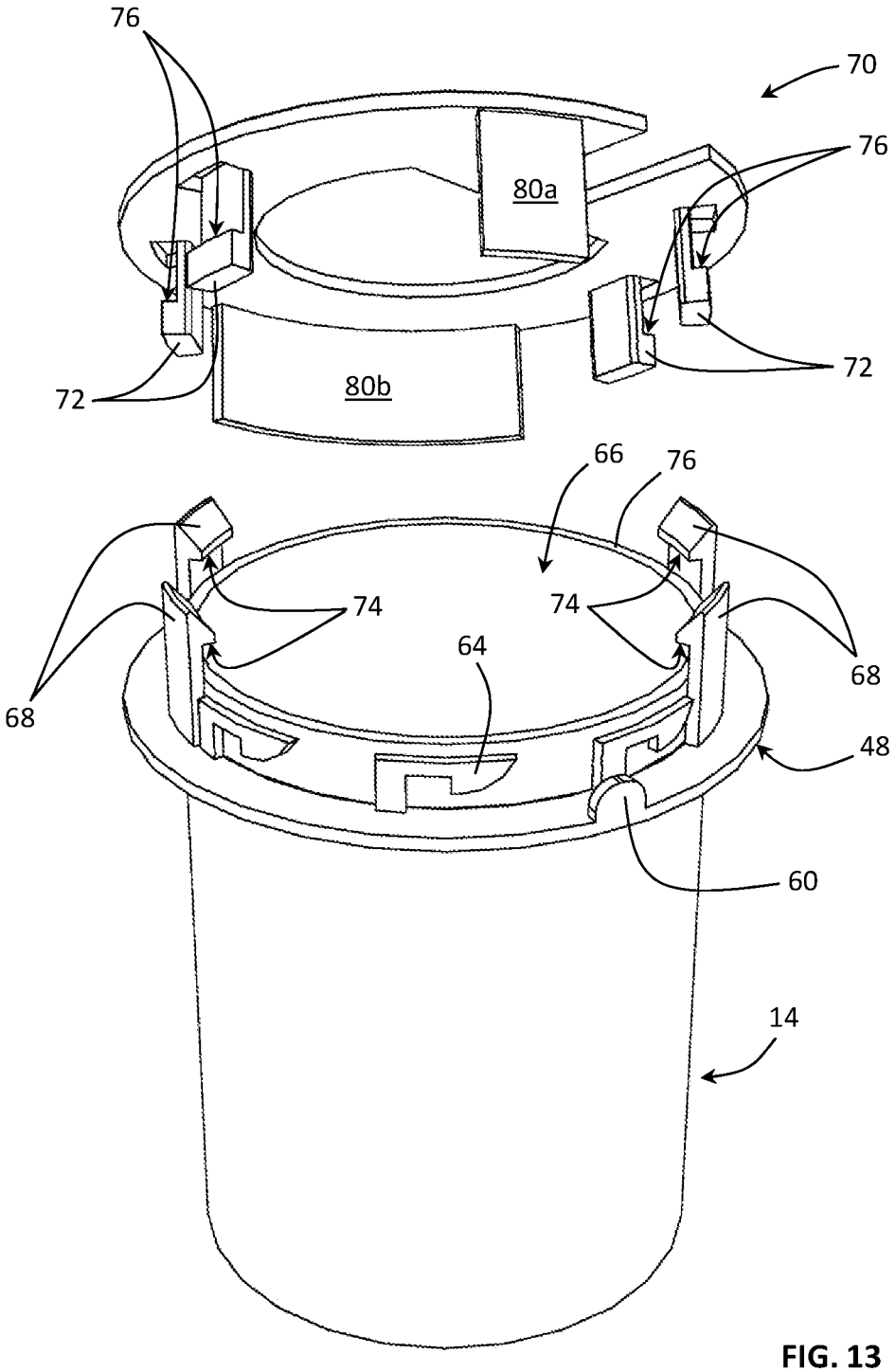
FIG. 13 is an exploded perspective view of an upper locking ring, container, and lower locking ring of the system of FIG. 10, wherein the lower locking ring is applied to the container in accordance with the present invention.
Figure 14:
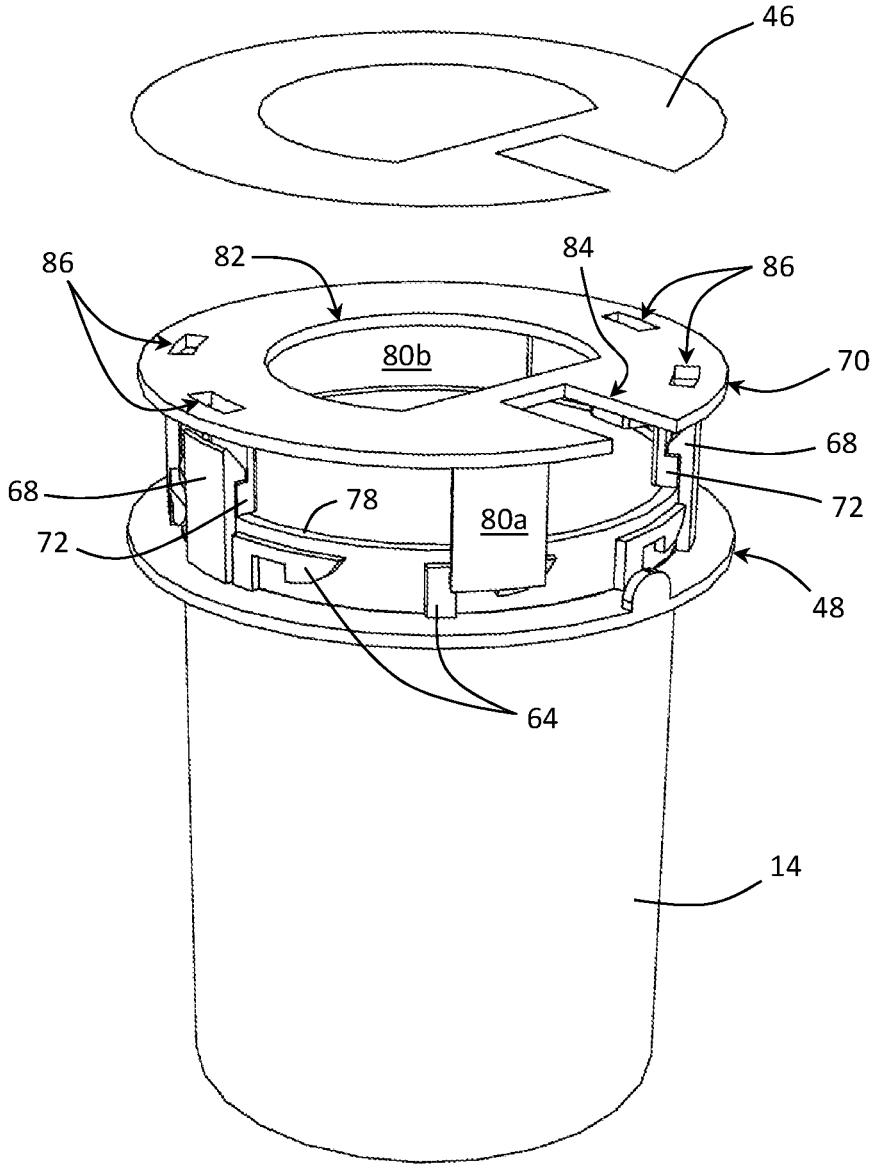
FIG. 14 is an exploded perspective view of a seal, upper locking ring, container, and lower locking ring of the system of FIG. 10, wherein the upper and lower locking rings are applied to the container in accordance with the present invention.
Figure 15:
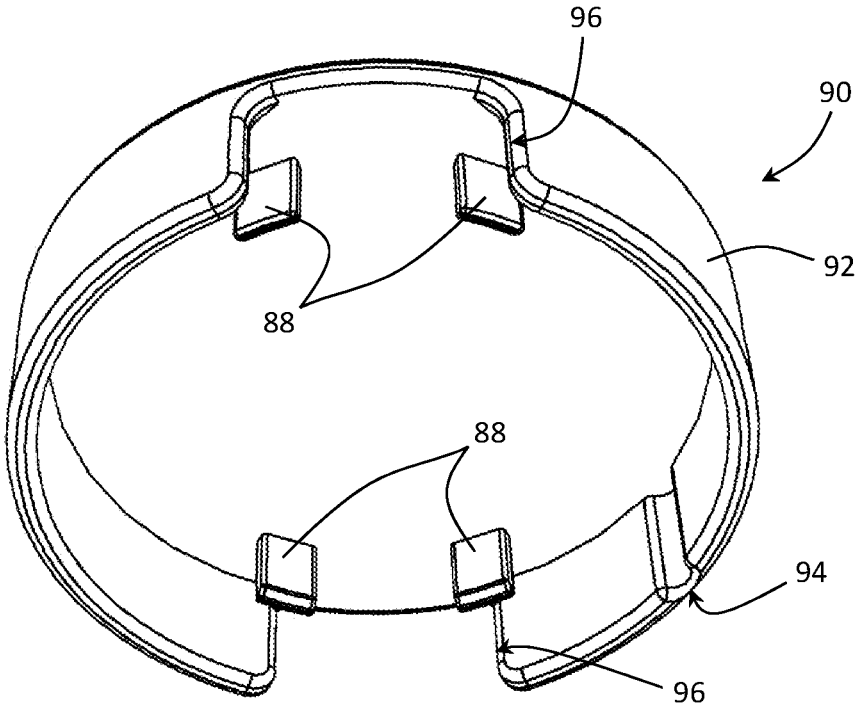
FIG. 15 is a perspective view of one embodiment of an unlocking tool configured to remove a cap of the system of FIG. 10.
Figure 16:
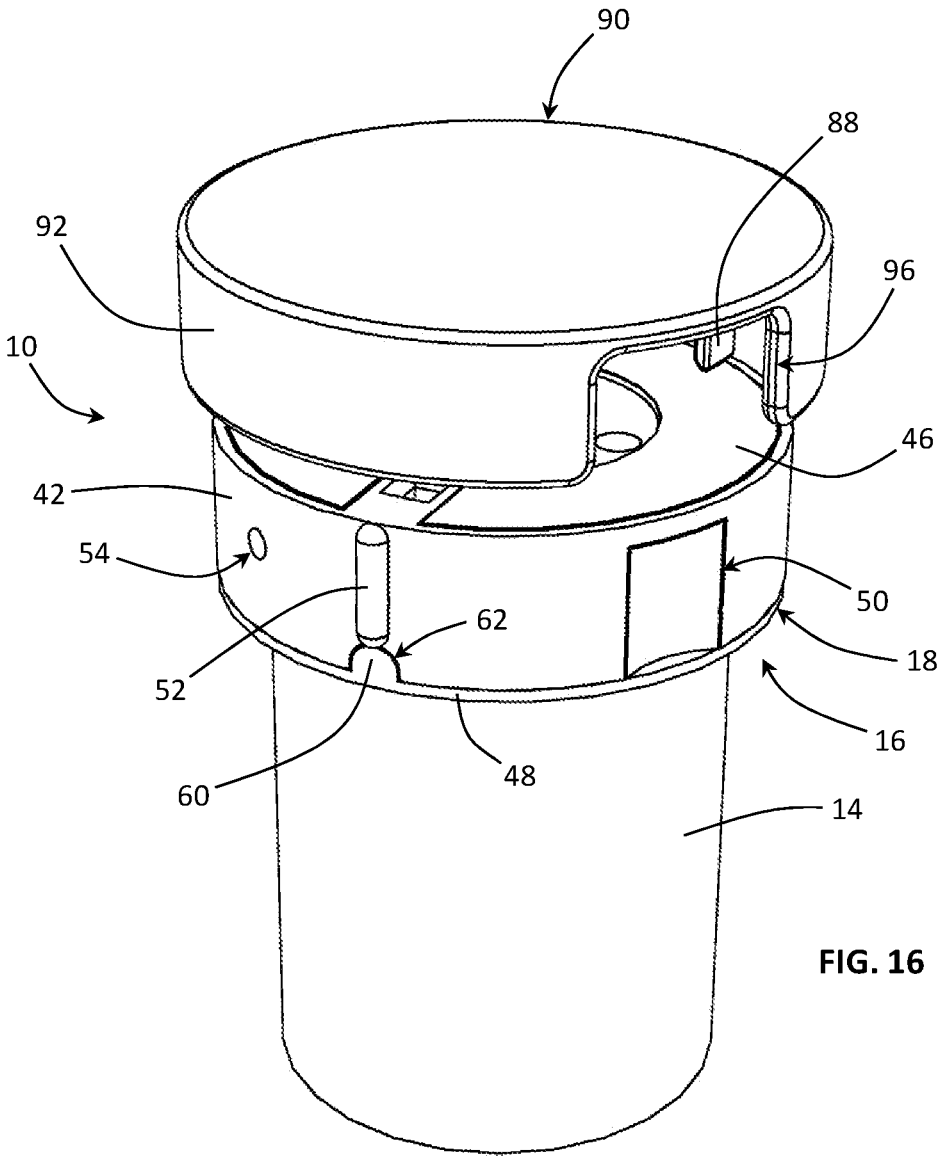
FIG. 16 is a perspective view of the unlocking tool of FIG. 15 being applied to the system of FIG. 10.
Figure 17:
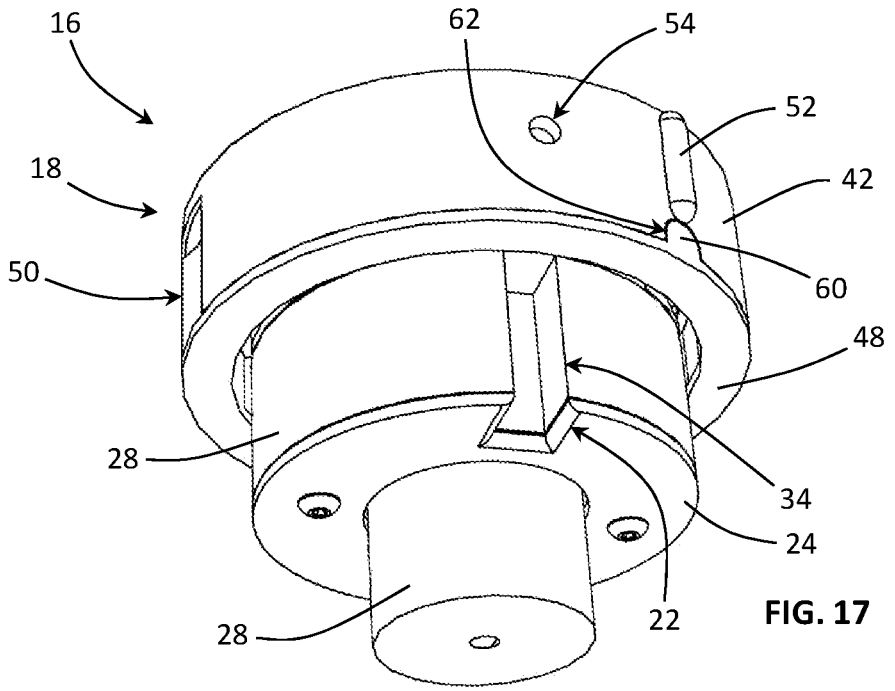
FIG. 17 is a perspective view of a cap of the system of FIG. 10.
Figure 18:
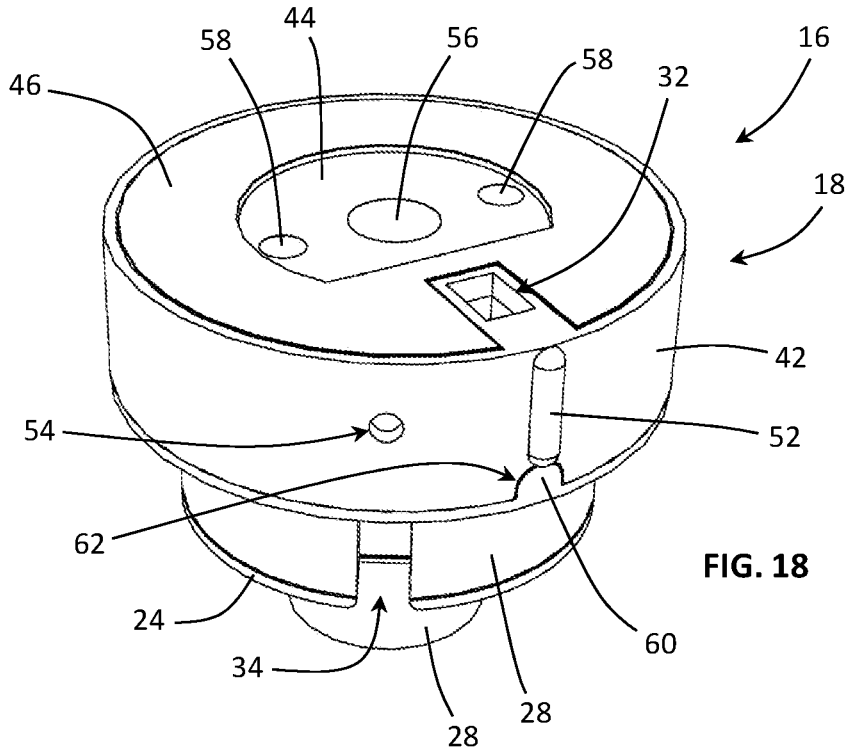
FIG. 18 is another perspective view of a cap of the system of FIG. 10.
Figure 19:
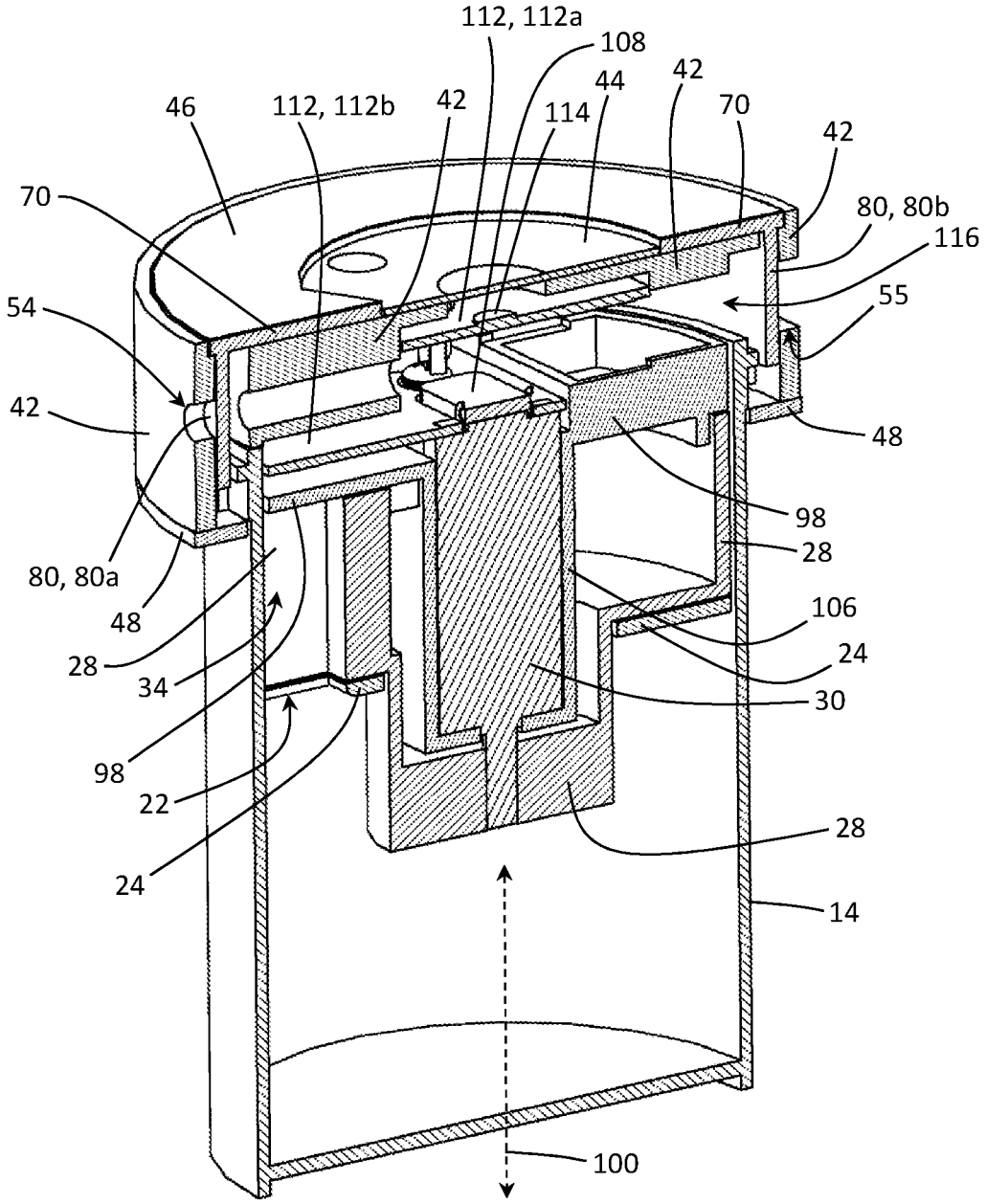
FIG. 19 is a cross-sectional perspective view of the system of FIG. 10.
Figure 20:
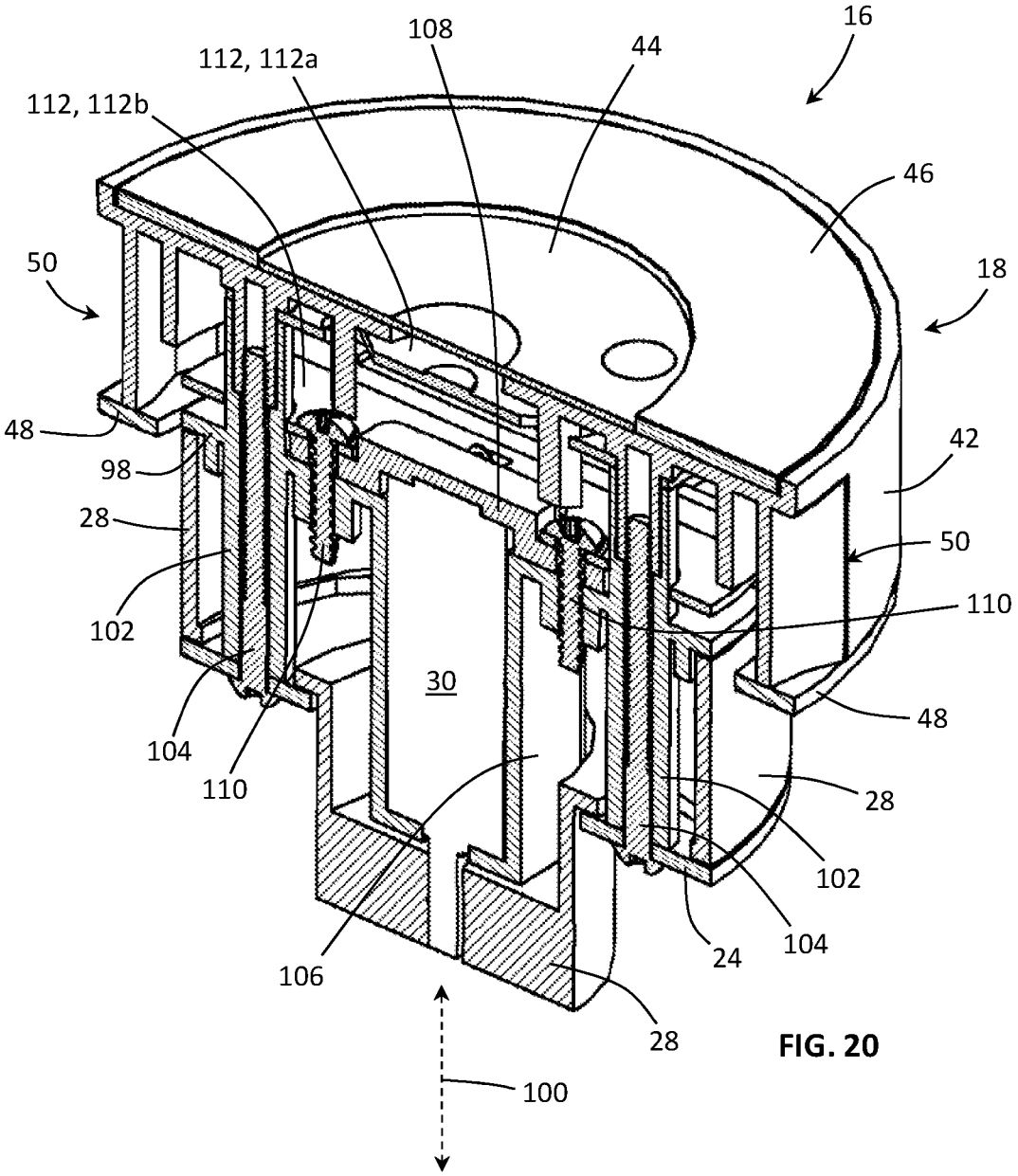
FIG. 20 is a cross-sectional perspective view of a cap of the system of FIG. 10.

Referring to FIGS. 10 and 11, in selected embodiments, an outer cover 18 of a cap 16 may include a main body 42, user interface 44, seal 46, and lower locking ring 48. A main body 42 may include or define an exit aperture 32. A main body 42 may also include one or more indentations 50 that may facilitate gripping a cap 16 during a cap-removal process. A main body 42 may also include an alignment mechanism 52. For example, a main body 42 may include an alignment mechanism 52 configured as an extension that may aid in aligning an unlocking key during a cap-removal process. A main body 42 may also include a battery-removal aperture 54. A battery-removal aperture 54 may provide a location where an elongated element or tool may be inserted in order to push a battery out an opposite side of the main body 42 (e.g., out a battery aperture 55 of a main body 42).

A user interface 44 may provide a location for a user to interact or communicate with a system 10 in accordance with the present invention. In selected embodiments, a user interface 44 may include one or more buttons 56. Alternatively, or in addition thereto, a user interface 44 may include one or more feedback devices 58. A feedback device 58 may be a light (e.g., an LED), speaker, segment display, or the like.

In certain embodiments, a user may press a button 56 to indicate that he or she would like to obtain medication 12 from the system 10. A system 10 may communicate with the user via one or more feedback devices 58. For example, if a user presses a button 56 to indicate that he or she would like to obtain medication 12 from the system 10, the system 10 may determine whether it would be appropriate (e.g., compliant with a corresponding prescription) to dispense medication 12. If it is appropriate to dispense medication 12, a feedback device 58 may so indicate (e.g., a feedback device 58 comprising a green LED may be illuminated). This may promote a user to move forward with a dispensing process (e.g., invert a system 10 and gently shake it to load a tablet or capsule of the medication 12 into a chute 34). Conversely, if it is not appropriate to dispense medication 12, a feedback device 58 may so indicate (e.g., a feedback device 58 comprising a red LED may be illuminated). Thus, in selected embodiments, a user interface 44 may include one button 56 and two feedback devices 58 (e.g., one green light and one red light) bracketing the button 56.

A user interface 44 may include a feedback device 58 in the form of a speaker. For example, if a user presses a button 56 to indicate that he or she would like to obtain medication 12 from the system 10, the system 10 may determine whether it would be appropriate to dispense medication 12. If it is appropriate to dispense medication 12, a feedback device 58 may emit a positive sound. This may promote a user to move forward with a dispensing process. Conversely, if it is not appropriate to dispense medication 12, a feedback device 58 may emit a negative sound. Thus, a user interface 44 may provide visual feedback, audio feedback, or both visual and audio feedback.

A seal 46 may prevent or reveal tampering. For example, in selected embodiments, an unlocking key may be used during a cap-removal process. A seal 46 may cover one or more apertures used by an unlocking key during such a process. Accordingly, if a seal 46 evidences that it has been penetrated, removed, or otherwise tampered with, a medical professional (e.g., a prescribing doctor, pharmacy, or the like) may be alerted that the user may be abusing the medication 12. In selected embodiments, a seal 46 may be a fragile membrane of paper, aluminum foil, plastic, or the like or a combination thereof with a strong adhesive applied to one side thereof. Accordingly, if a user attempts to remove the seal 46, the membrane may break, tear, rupture, or the like well before the strength of the adhesive can be overcome.

A lower locking ring 48 may assist in securing a cap 16 to a container 14. In selected embodiments, a lower locking ring 48 may abut against a lower surface of a main body 42. In such embodiments, a lower locking ring 48 may include an extension 60 shaped to engage (e.g., extend into) a corresponding aperture 62 in a main body 42. This may index a lower locking ring 48 and a main body 42 and ensure that they are properly aligned with respect to one another during an assembly process.

Referring to FIGS. 12-15, 26, and 27, in selected embodiments, a container 14 may be a standard polymeric prescription vial or bottle. In such embodiments, a container 14 may include various locking structures 64 shaped to receive a standard child-proof cap. In certain embodiments, these locking structures 64 may enable a cap 16 in accordance with the present invention to grip and lock onto the corresponding container 14. For example, a lower locking ring 48 may be slipped over a closed end of a container 14. The lower locking ring 48 may slide up the container 14 until it contacts an under side of the locking structures 64. The locking structures 64 may prevent a lower locking ring 48 from sliding off the open end 66 of the container 14.

Once a lower locking ring 48 is in place, one or more locking extensions 68 thereof may extend to engage a complementary component and lock a cap 16 to the container 14. For example, in selected embodiments, a cap 16 may include an upper locking ring 70. In selected embodiments, an upper locking ring 70 may include one or more locking extensions 72 that extend to engage corresponding locking extensions 68 of a lower locking ring 48. The various locking extensions 68, 72 may have respective engagement shoulders 74, 76. Thus, the engagement shoulders 74 of the locking extensions 68 of the lower locking ring 48 may engage the engagement shoulders 76 of the locking extensions 72 of the upper locking ring 70.

Additionally, the locking extensions 72 of the upper locking ring 70 may abut an upper rim 78 or lip 78 of a container 14. Thus, when a cap 16 is applied to a container 14, the various engagements of (1) the lower locking ring 48 with an underside of the locking structures 64 of the container, (2) the upper locking ring 70 with the top lip 78 or rim 78 of the container 14, and (2) the locking extensions 68 of the lower locking ring 48 with the locking extensions 72 of the upper locking ring 48 may cooperate to securely fix the cap 16 on the container 14.

In selected embodiments, an upper locking ring 70 may include one or more blocking extensions 80. For example, when a cap 16 is fully assembled, a first blocking extension 80*a* may block a battery-removal aperture 54 and a second blocking extension 80*b* may block a battery aperture 55 (e.g., an aperture 55 in a main body 42 through which a battery 31 may be inserted or removed). Thus, when a cap 16 is fully assembled, a battery 31 may not be removed in an effort to circumvent the security processes of a system 10 in accordance with the present invention.

Referring to FIGS. 14-17, in selected embodiments, an upper locking ring 70 may have various apertures 82, 84, 86 formed therein. For example, an upper locking ring 70 may include a central aperture 82 providing a space for a user interface 44. An upper locking ring 70 may also include an exit cutout 84 providing a space for the portion of a main body 42 defining an exit aperture 32. An upper locking ring 70 may also include one or more key apertures 86.

A key aperture 86 may be shaped and positioned to receive an unlocking key 88 therewithin. When an unlocking key 88 is inserted within a key aperture 86, it may disengage the engagement shoulders 74, 76 of corresponding locking extensions 68, 72 of the lower and upper locking rings 48, 70. Thus, the number and location of key apertures 86 in an upper locking ring 70 may correspond to the number and location of the engagements between locking extensions 68, 72 of the respective lower and upper locking rings 48, 70.

In certain embodiments, a seal 46 may have a shape (e.g., a perimeter) that matches or substantially matches a perimeter of a top surface 89 of an upper locking ring 70. Thus, like an upper locking ring 70, a seal 46 may have certain apertures formed therein. This may enable a seal 46 to cover one or more key apertures 86 without covering a user interface 44 or an exit aperture 32. Accordingly, since an upper locking ring 70 may provide the structure supporting a seal 46, an upper locking ring 70 may be considered to be part of an outer cover 18 of a cap 16.

In selected embodiments, an unlocking tool 90 may include one or more unlocking keys 88. The number and location of the one or more unlocking keys 88 on an unlocking tool 90 may correspond to the number and location of the key apertures 86. Accordingly, when an unlocking tool 90 is applied to a cap 16 installed on a container 14 in accordance with the present invention, the unlocking tool 90 may simultaneously release all engagements of the lower locking ring 48 with the upper locking ring 70. Thus, applying an unlocking tool 90 to a cap 16 may enable the cap 16 to be removed from the corresponding container 14.

In certain embodiments, an unlocking tool 90 may include various features that facilitate proper alignment of the tool 90 with a cap 16 that is to be removed. Such features may include a border 92 shaped to closely follow and encircle a cap 16. Additionally, a border 92 may have an indentation 94 formed therein. An indentation 94 may be sized and shaped to receive an alignment mechanism 52 of a cap 16. Accordingly, a border 92 combined with an indentation 94 may ensure that an unlocking tool 90 may only be applied to a cap 16 when the tool 90 is properly aligned with the cap 16.

In selected embodiments, an unlocking tool 90 may include one or more cutouts 96. Such cutouts 96 may be positioned to expose one or more indentations 50 formed in a cap 16 whenever the tool 90 is applied to the cap 16. Accordingly, in a cap-removal process, an unlocking tool 90 may be positioned proximate a cap 16 and aligned therewith. The unlocking tool 90 may then be advanced unto the cap 16. This advancing may cause the unlocking keys 88 to penetrate a seal 46 and advance into corresponding key apertures 86.

Once the unlocking tool 90 is fully seated onto a cap 16, a user may access one or indentations 50 in the cap 16 through corresponding cutouts 96 in the unlocking tool 90. Thereafter, pulling the cap 16 and tool 90 away from the container 14 may result in the majority of the cap 16 being removed from the container 14. That is, the lower locking ring 48 may be left behind, but most of the cap 16 may be removed. Accordingly, the medication 12 within the container 14 may be refilled. Thereafter, the cap 16 may be reassembled on the container 14 and the refilled system 10 may be reused (e.g., returned to the appropriate patient with a new seal 46 in place).

Referring to FIGS. 17-20, 30-32, 35, and 36, in selected embodiments, a cap 16 in accordance with the present invention may include an outer cover 18, an inner cover 24, an interface 98, and a control system. An outer cover 18 may include a main body 42, user interface 44, seal 46, lower locking ring 48, upper locking ring 70, or the like or combination or sub-combination thereof. An inner cover 24 may have an entrance gate 22 or aperture 22 formed therein. An interface 98 may extend to connect and rotationally fix an outer cover 18 with respect to an inner cover 24.

An interface 98 may space an outer cover 18 with respect to an inner cover 24 in an axial direction 100 to enable a transport portion 28 to rotate between the outer and inner covers 18, 24. In selected embodiments, an interface 98 may include one or more posts 102 that extend in the axial direction 100. The posts 102 may include apertures therewithin shaped and sized to receive threaded fasteners 104. On a lower end thereof, the posts 102 may contact and support an inner cover 24. On an upper end thereof, the posts 102 may contact and support a main body 42 of an outer cover 18. Accordingly, fasteners 104 extending within the posts 102 may connect an inner cover 24 and an outer cover 18 to an interface 98 (and, thereby, to each other) and maintain a space between the inner and outer covers 24, 18 for a transport portion 28 to reside and move (e.g., rotate or pivot about a central axis extending in the axial direction 100).

In certain embodiments, an interface 98 may also provide a structure to which or within which one or more components of a control system may be mounted. For example, an interface 98 may include an actuator housing 106 and an actuator mount 108. An actuator housing 106 may provide a location for an actuator 30 to reside. In selected embodiments, an actuator 30 may comprise an electrical motor and an associated gear reduction system. Accordingly, an actuator housing 106 may house the electrical motor and associated gear reduction system. An actuator mount 108 may lock or secure an actuator 30 within an actuator housing 106. In certain embodiments, fasteners 110 (e.g., threaded fasteners) may removably secure an actuator mount 108 to the rest of an interface 98.

In selected embodiments, a control system may control the operation of a system 10 in accordance with the present invention. Accordingly, a control system may determine with sufficient time has passed since a first portion of medication 12 was dispensed for it to be appropriate (e.g., compliant with a prescription corresponding to the medication 12) to dispense a second portion of the medication 12.

In certain embodiments, a control system may include one or more circuit boards 112, an actuator 30, one or more batteries 31, or the like or a combination or sub-combination thereof. For example, a control system may include an upper circuit board 112*a* and a lower circuit board 112*b*. An upper circuit board 112*a* may be configured to interact with or support the operation of a user interface 44. Accordingly, an upper circuit board 112*a* may include a switch or button 114 located below a button 56 of a user interface 44. Actuation of the button 56 on the user interface 44 may result in actuation of the switch 114 or button 114 on the upper circuit board 112*a*. An upper circuit board 112*a* may also include one or more lights (e.g., one or more LEDs) or the like corresponding to (e.g., providing source light for) one or more feedback devices 58 of a user interface 44.

A lower circuit board 112*b* may be larger than an upper circuit board 112*a* and have more components of a control system mounted thereon. For example, a lower circuit board 112*b* may include and appropriately connect a processor, memory, one or more speakers, one or more sensors 26, or the like or a combination thereof. In selected embodiments, one or more fasteners 110 securing an actuator mount 108 to the rest of an interface 98 may also secure a lower circuit board 112*b* to an interface 98.

In certain embodiments, a battery 31 may be a coin battery that may be inserted through a battery aperture 55 into a space 116 between an interface 89 and a main portion 42 of an outer cover 18. So positioned, a battery 31 may provide electrical power to one or more circuit boards 112 of other components (e.g., an actuator 30) of a control system.

Figure 21:
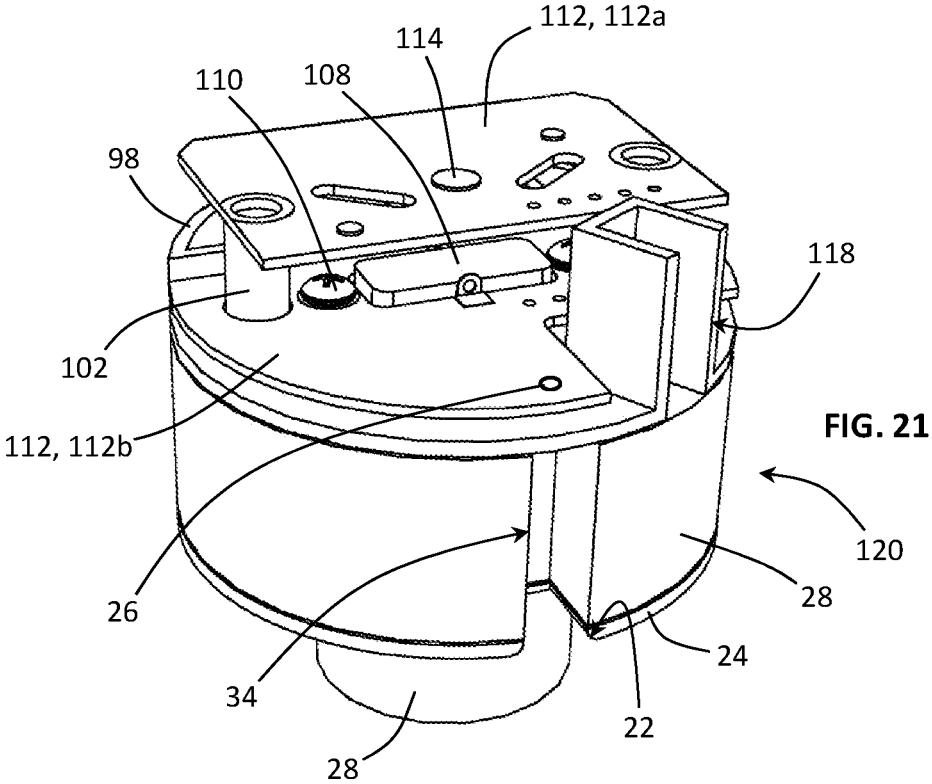
FIG. 21 is a perspective view of a partially assembled cap of the system of FIG. 10, wherein the chute of the transport portion is in a load position in accordance with the present invention.
Figure 22:
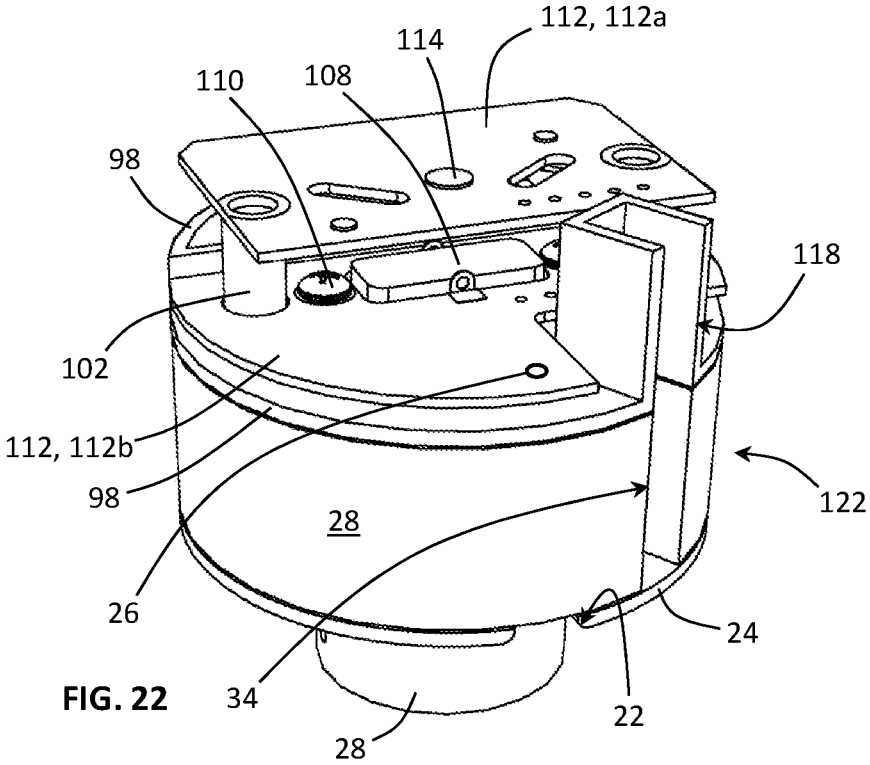
FIG. 22 is a perspective view of a partially assembled cap of the system of FIG. 10, wherein the chute of the transport portion is in an unload position in accordance with the present invention.

Referring to FIGS. 21 and 22, in selected embodiments, an interface 98 may include a channel 118 for conducting or passing medication 12. A channel 118 may have a location that is fixed with respect to, and aligned with, an exit aperture 32. Accordingly, when a chute 34 of a transport portion 28 pivots or rotates into alignment with an exit aperture 32, the chute 34 may also pivot or rotate into alignment with the channel 118 of an interface 98. This may enable medication 12 contained within the chute 34 to pass (e.g., fall when the system 10 is properly oriented for dispensing) out of the chute 34, pass through the channel 118 in the interface 98, and exit a system 10 through an exit aperture 32.

In certain embodiments, an interface 98 or selected portions thereof may be formed of a transparent or semi transparent material (e.g., a transparent or semi transparent polymeric material). This may enable one or more sensors 26 (e.g., one or more optical sensors 26) mounted on a circuit board 112*b* to see when a tablet, capsule, or the like of medication 12 is loaded within a chute 34 of a transport portion 28.

For example, in operation, a transport portion 28 may selectively move between a first location (e.g., a load position 120) corresponding to an alignment with an entrance aperture 22 and a second location (e.g., an unload position 122) corresponding to an alignment with an exit aperture 32. A sensor 26 may be positioned on a circuit board 112*b* so as to be proximate one end of the chute 34 when the transport portion 28 is in the load position 120. Accordingly, a sensor 26 may perceive through an interface 98 whether a tablet, capsule, or the like of the medication 12 is loaded within the chute 34.

Thus, in a dispensing operation, a user may press a button 56 to communicate his or her desire to receive a dose of medication 12. If it is an appropriate time to dispense a dose of the medication 12, a feedback device 58 may so indicate and a system 10 may prepare to dispense medication 12 (e.g., return a transport portion 28 to a load position 120 if it is not already in that position). Accordingly, the user may invert the system 10 and gently shake it until a tablet, capsule, or the like is loaded within a chute 34 of the transport portion 28.

When the control system detects via the sensor 26 that a tablet, capsule, or the like is loaded within the chute 34, the transport portion 28 may be moved (e.g., rotated or pivoted) to the unload position 122. In the unload position 122, the chute 34 may be axially aligned with an exit aperture 32. Accordingly, with the system 10 still inverted, medication 12 may fall out of the chute 34, pass through the channel 118, and exit the system 10 through an exit aperture 32.

Figure 23:
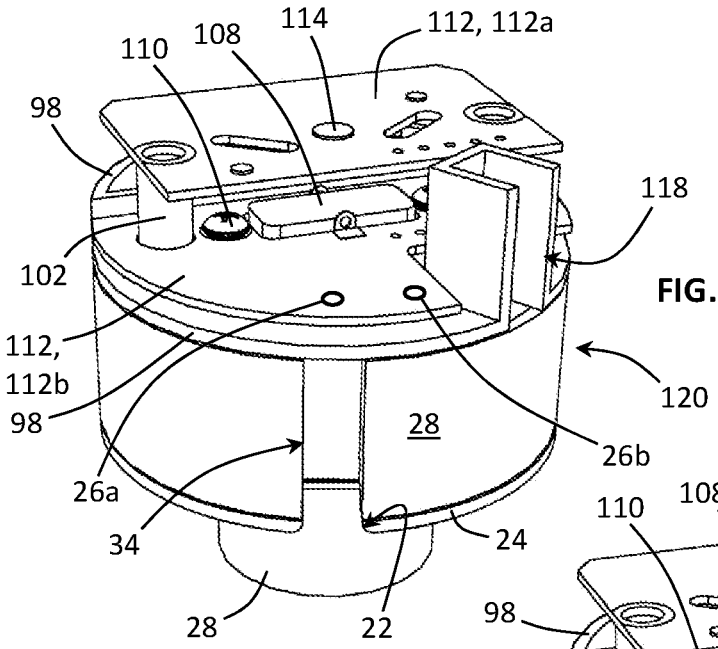
FIG. 23 is a perspective view of a partially assembled cap of an alternative embodiment of a system in accordance with the present invention, wherein the chute of the transport portion is in a load position.
Figure 24:
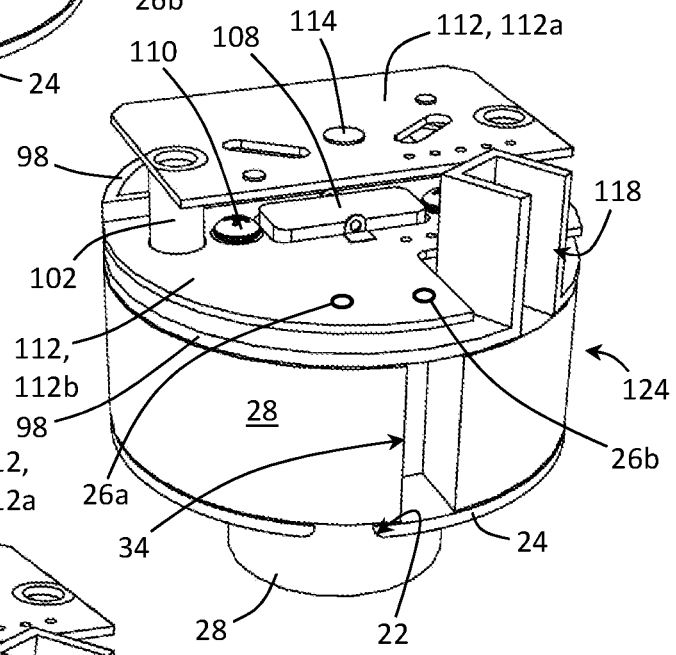
FIG. 24 is a perspective view of the partially assembled cap of FIG. 23, wherein the chute of the transport portion is in an intermediate position.
Figure 25:
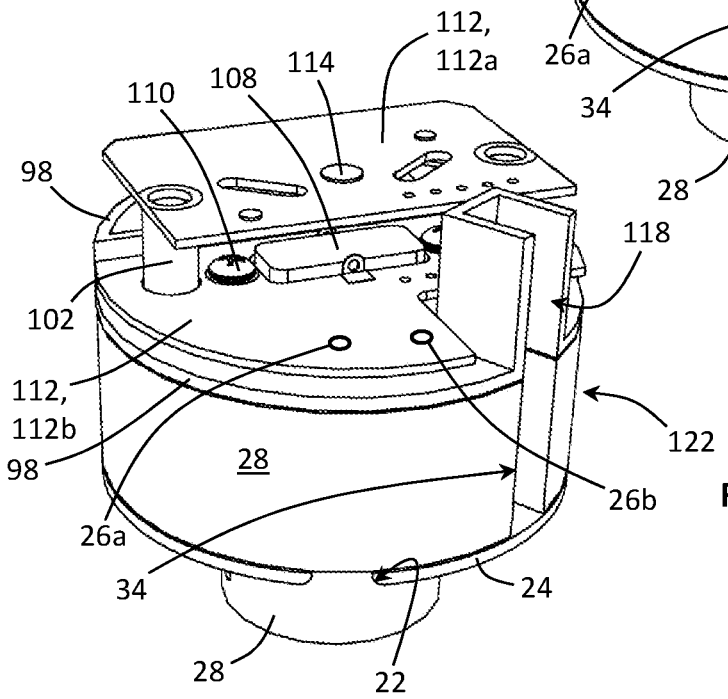
FIG. 25 is a perspective view of the partially assembled cap of FIG. 23, wherein the chute of the transport portion is in an unload position.
Figure 26:
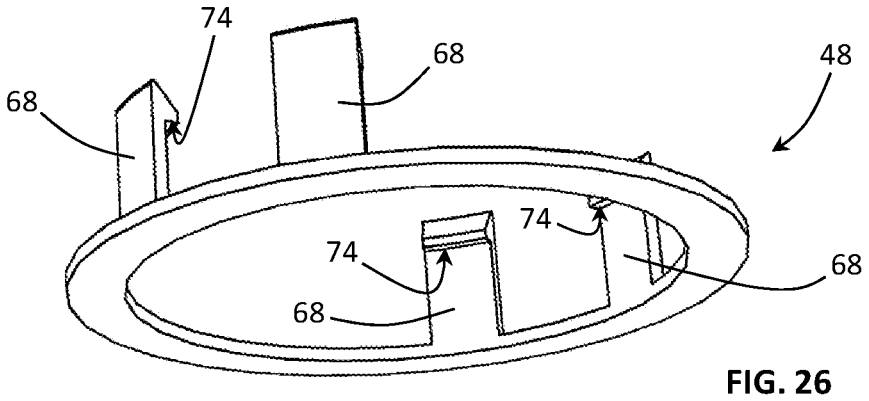
FIG. 26 is a perspective view of a lower locking ring of the system of FIG. 10.
Figure 27:
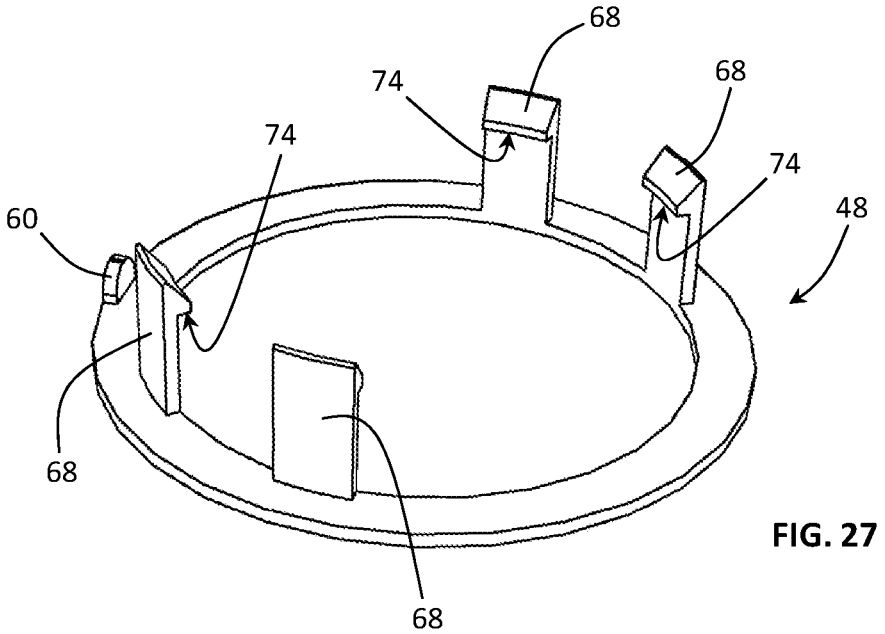
FIG. 27 is another perspective view of a lower locking ring of the system of FIG. 10.

Referring to FIGS. 23-25, in selected embodiments, a system 10 may be configured to detect when medication 12 is dispensed. This may ensure that an empty chute 34 is not rotated into alignment with an exit aperture 32 and counted as a dispensing of medication 12, which would deprive a patient of the benefit of the medication 12. Accordingly, in certain embodiments, a transport portion 28 may be rotated or pivoted through a range of motion that includes a load position 120 corresponding to an alignment with an entrance aperture 22, an intermediate position 124 corresponding to misalignment with both the entrance and exit apertures 22, 32, and an unload position 122 corresponding to an alignment with an exit aperture 32. A first sensor 26*a* may be positioned on a circuit board 112*b* so as to be proximate one end of the chute 34 when the transport portion 28 is in the load position 120. Accordingly, a sensor 26*a* may perceive through an interface 98 whether a tablet, capsule, or the like of the medication 12 is loaded within the chute 34.

Thus, in a dispensing operation, a user may press a button 56 to communicate his or her desire to receive a dose of medication 12. If it is an appropriate time to dispense a dose of the medication 12, a feedback device 58 may so indicate and a system 10 may prepare to dispense medication 12. Accordingly, the user may invert the system 10 and gently shake it until a tablet, capsule, or the like is loaded within a chute 34 of the transport portion 28.

When the control system detects via the sensor 26*a* that a tablet, capsule, or the like is loaded within the chute 34, the transport portion 28 may be moved (e.g., rotated or pivoted) to or through the intermediate position 124. As the transport portion 28 rests in or passes through the intermediate position 124, a second sensor 26*b* may perceive through an interface 98 whether a tablet, capsule, or the like of the medication 12 is loaded within the chute 34.

In the intermediate position 124, the chute 34 may be closed (or mostly or sufficiently closed) at both ends thereof. If a tablet or capsule of medication 12 is present within the chute 34 in the intermediate position 124, there may be no chance that the tablet or capsule will inadvertently fall back into the container 14. Accordingly, if a tablet or capsule of medication 12 is present within the chute 34 in the intermediate position 124, there may be no chance that an empty chute 34 is rotated into alignment with an exit aperture 32 and counted as a dispensing of medication 12.

If a second sensor 26*b* perceives through an interface 98 that a tablet, capsule, or the like of the medication 12 is not loaded within the chute 34, the control system may return the transport portion 28 to the load position 120. Thereafter, the process for loading and detecting a tablet or capsule within a chute 34 may be repeated. Conversely, if a second sensor 26*b* perceives through an interface 98 that a tablet, capsule, or the like of the medication 12 is loaded within the chute 34, the control system may move the transport portion 28 on to the unload position 122.

Figure 28:
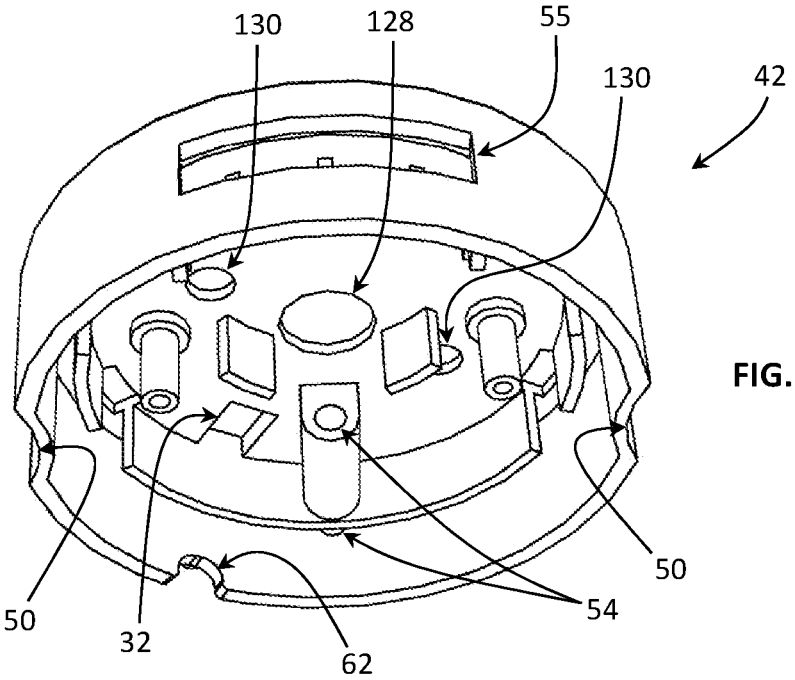
FIG. 28 is a perspective view of a main body of an outer cover of the system of FIG. 10.
Figure 29:
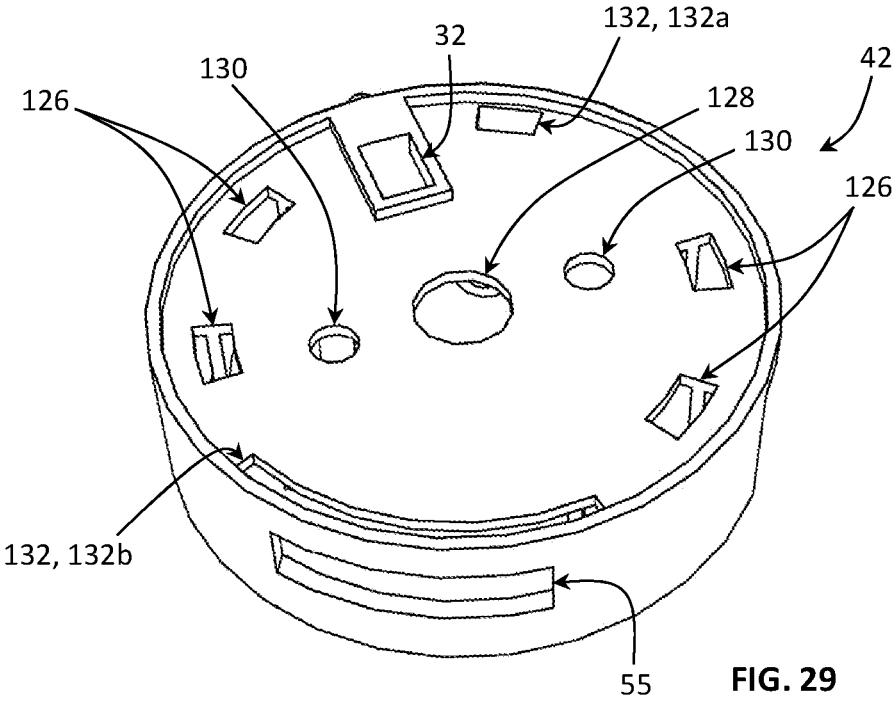
FIG. 29 is another perspective view of a main body of an outer cover of the system of FIG. 10.
Figure 30:
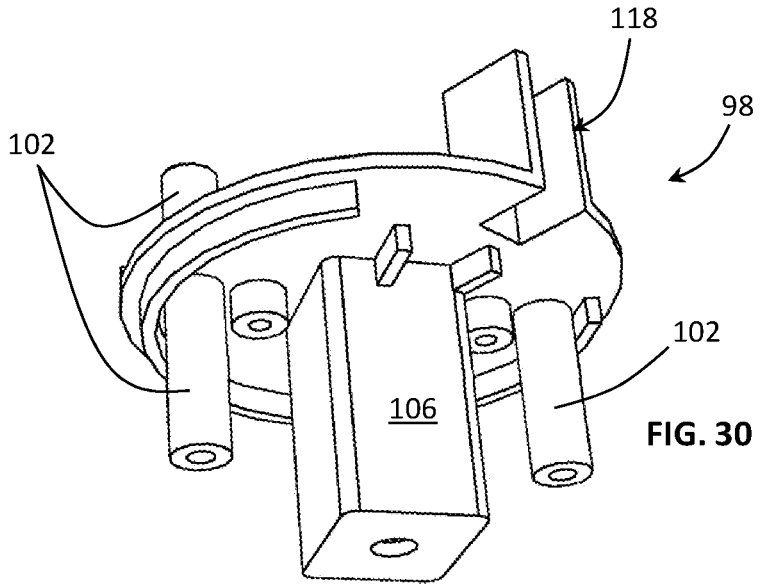
FIG. 30 is a perspective view of an interface of the system of FIG. 10.
Figure 31:
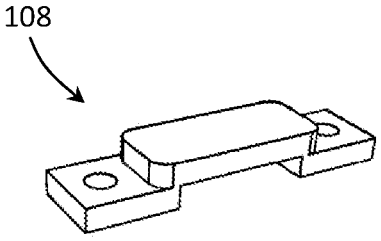
FIG. 31 is a perspective view of an actuator mount of the system of FIG. 10.
Figure 32:
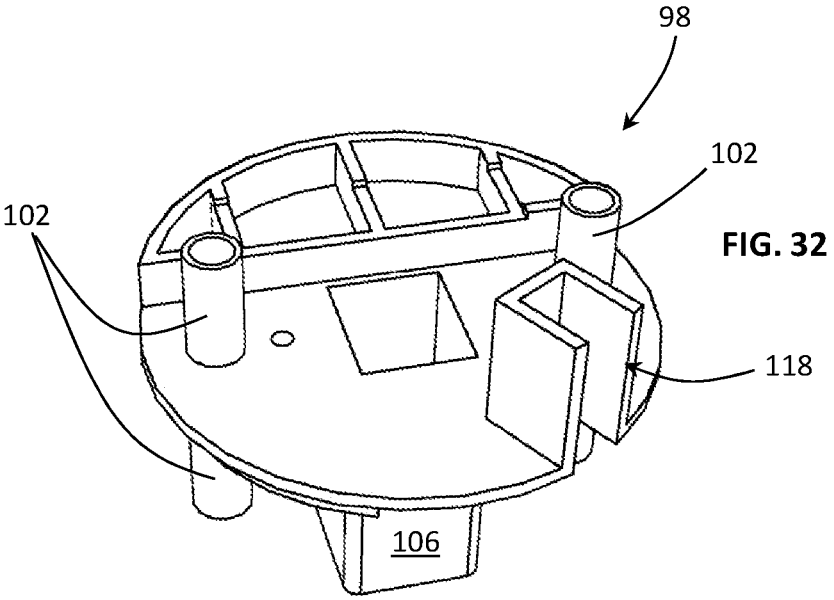
FIG. 32 is another perspective view of an interface of the system of FIG. 10.

Referring to FIGS. 28 and 29, in addition to an exit aperture 32, a top surface of a main body 42 of an outer cover 18 may have other apertures extending therethrough. For example, a top of a main body 42 may have one or more extension apertures 126, button apertures 128, feedback apertures 130, blocking apertures 132, or the like or combinations or sub-combinations thereof extending therethrough.

An extension aperture 126 may provide a location for a locking extension 72 and corresponding unlocking key 88 to pass through a main body 42. A button aperture 128 may provide a path for a button 56 of a user interface 44 to access a button 114 of a circuit board 112*a*. A feedback aperture 130 may provide a path for light from a light source on a circuit board 122*a* to reach a feedback device 58 of a user interface 44. A blocking aperture 132 may provide a location for a blocking extension 80 to pass through a main body 42. For example, a first blocking aperture 132*a* may provide a location for a first blocking extension 80*a* to pass through a main body 42 and a second blocking aperture 132*b* may provide a location for a second blocking extension 80*b* to pass through a main body 42.

Figure 33:
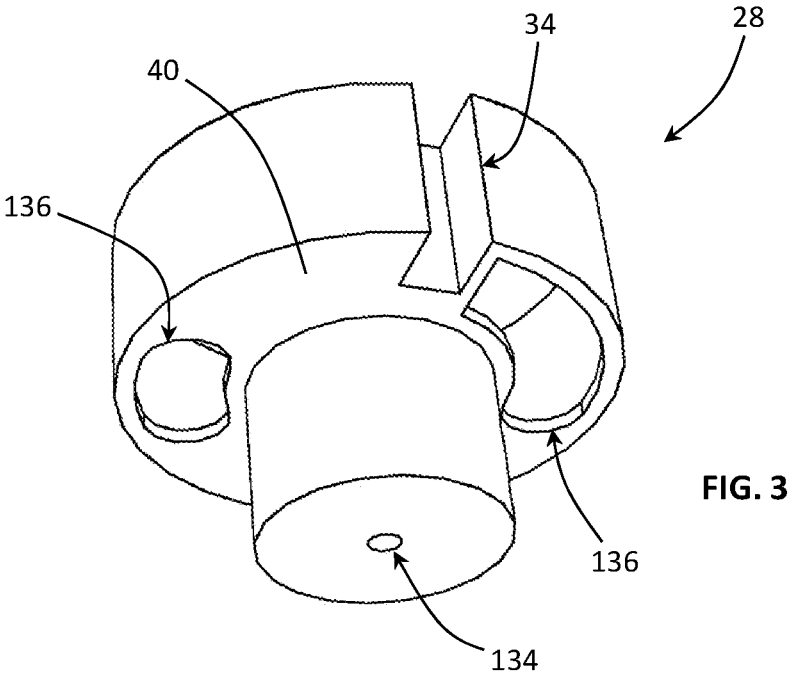
FIG. 33 is a perspective view of a transport portion of the system of FIG. 10.
Figure 34:
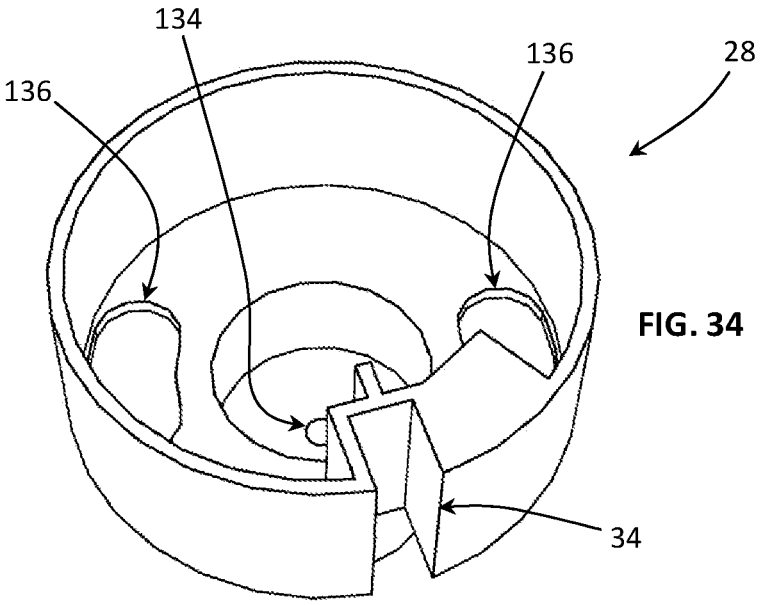
FIG. 34 is another perspective view of a transport portion of the system of FIG. 10.
Figure 35:
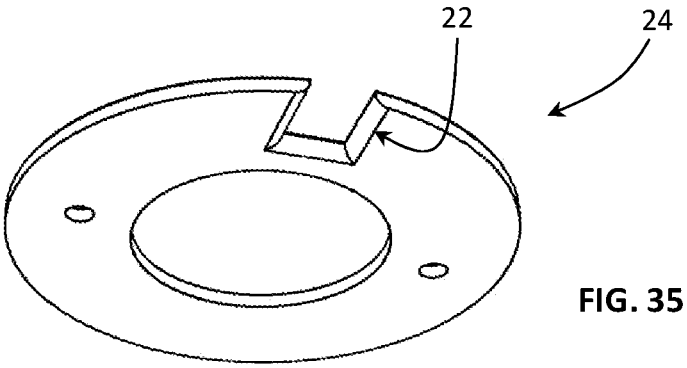
FIG. 35 is a perspective view of an inner cover of the system of FIG. 10.
Figure 36:
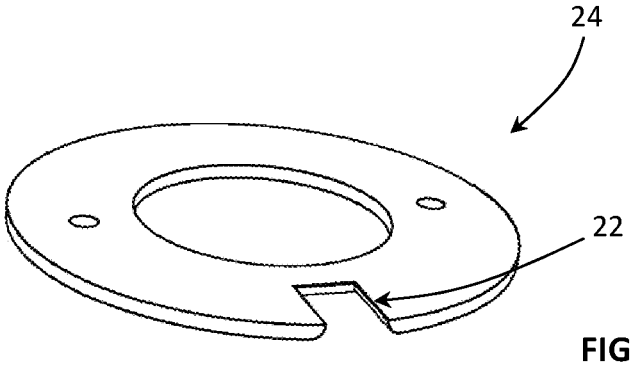
FIG. 36 is another perspective view of an inner cover of the system of FIG. 10.
Figure 37:
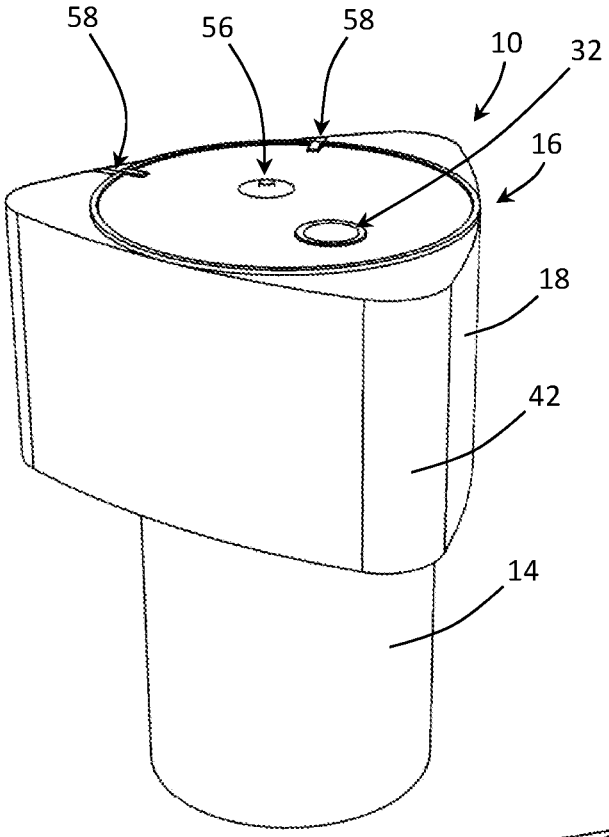
FIG. 37 is a perspective view of another alternative embodiment of a system in accordance with the present invention.
Figure 38:
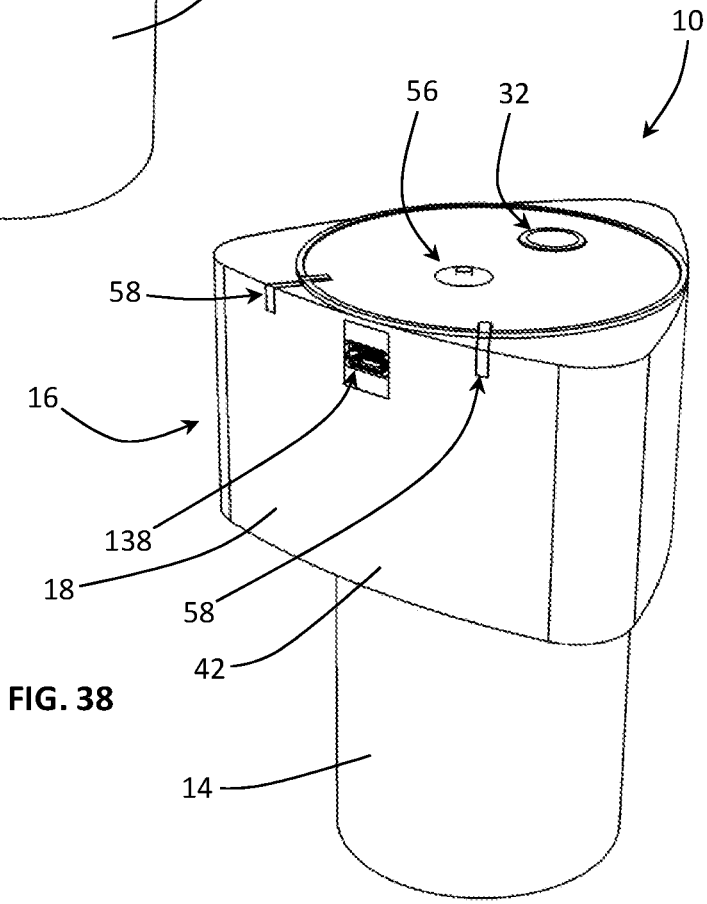
FIG. 38 is another perspective view of the system of FIG. 37.
Figure 39:
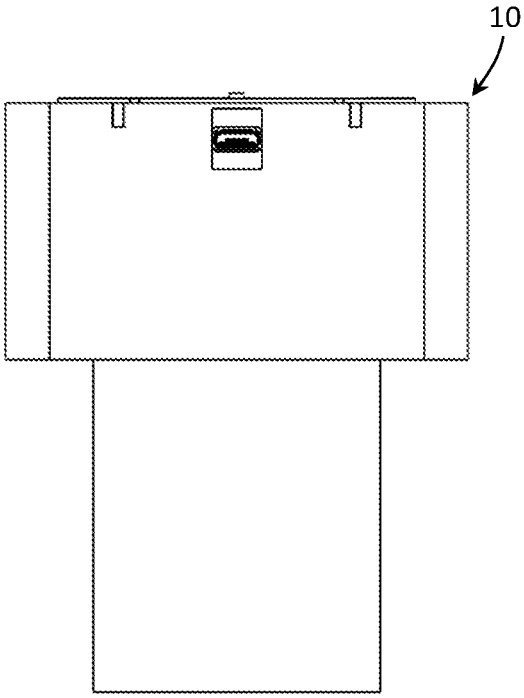
FIG. 39 is a front elevation view of the system of FIG. 37.
Figure 40:
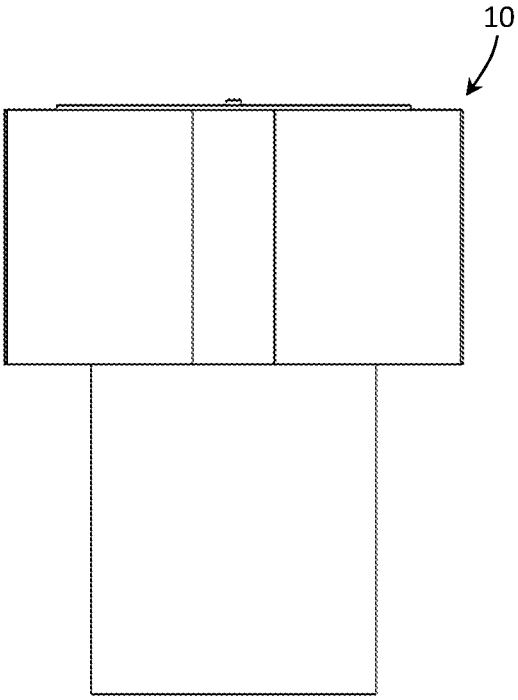
FIG. 40 is a back elevation view of the system of FIG. 37.
Figure 41:
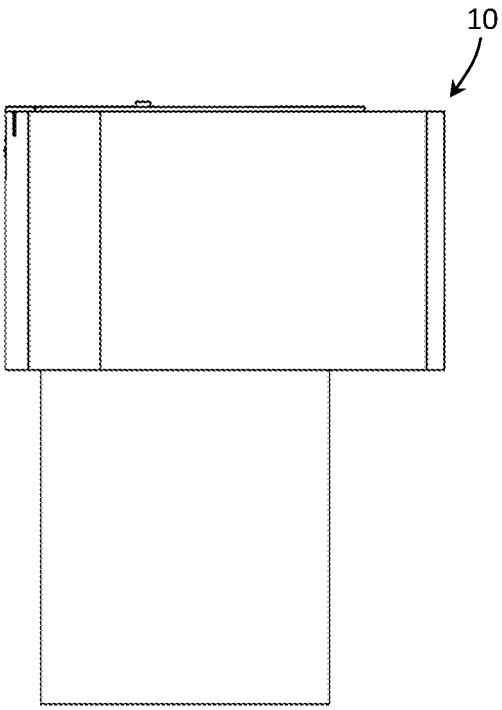
FIG. 41 is a first side elevation view of the system of FIG. 37.
Figure 42:
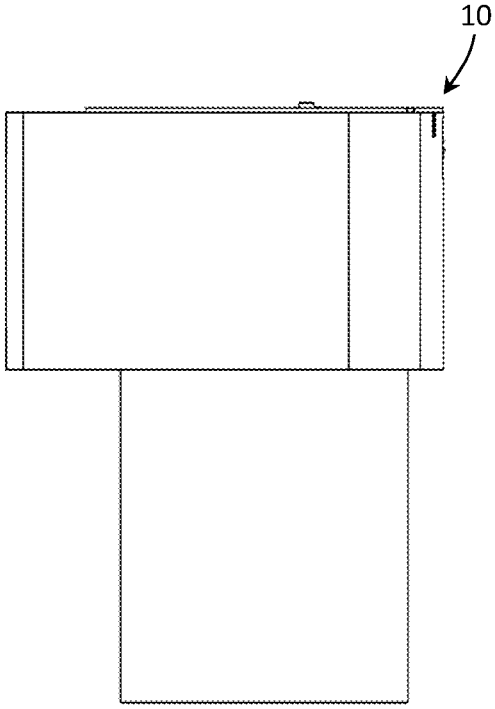
FIG. 42 is a second, opposite side elevation view of the system of FIG. 37.
Figure 43:
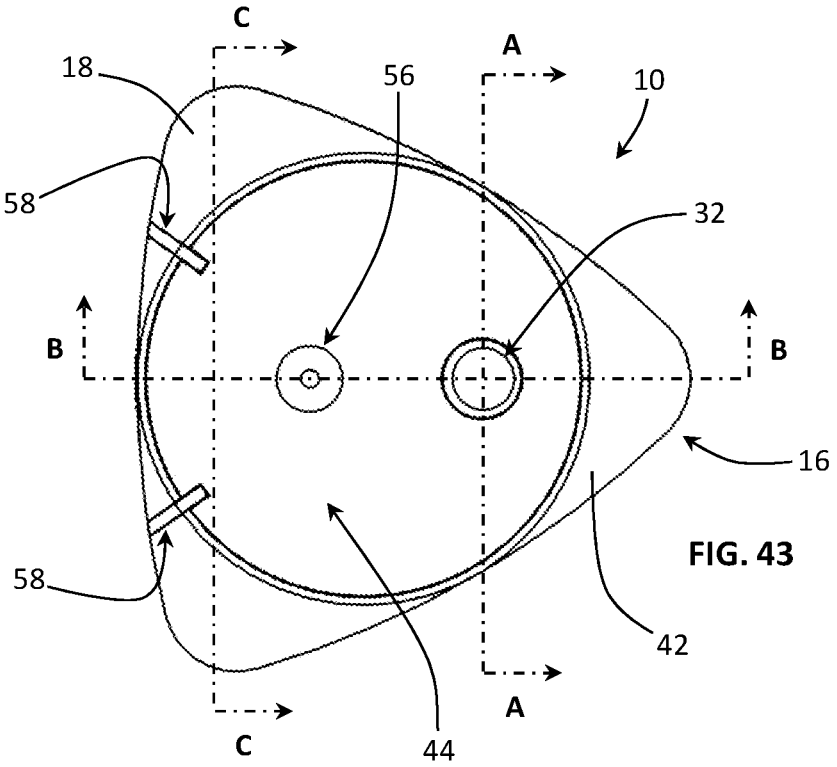
FIG. 43 is a top plan view of the system of FIG. 37.
Figure 44:
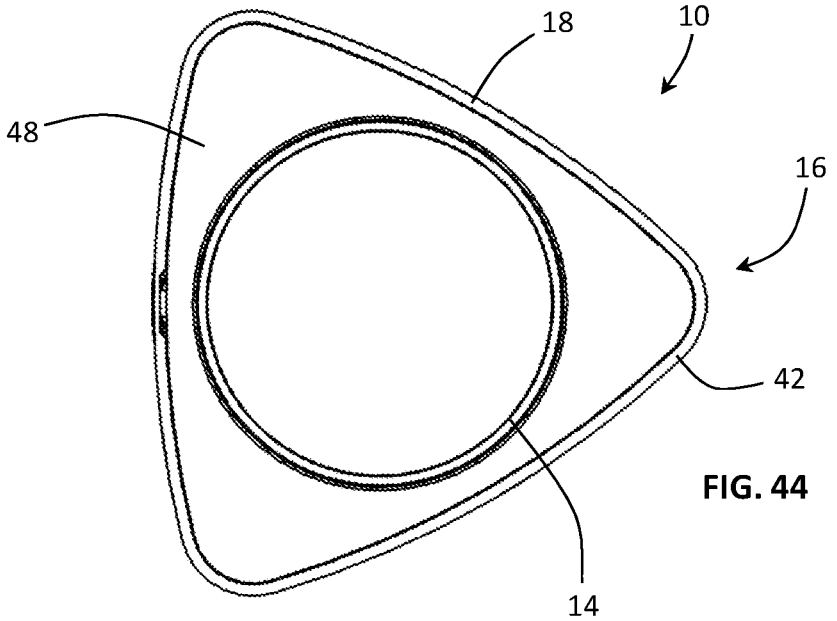
FIG. 44 is a bottom plan elevation view of the system of FIG. 37.
Figure 45:
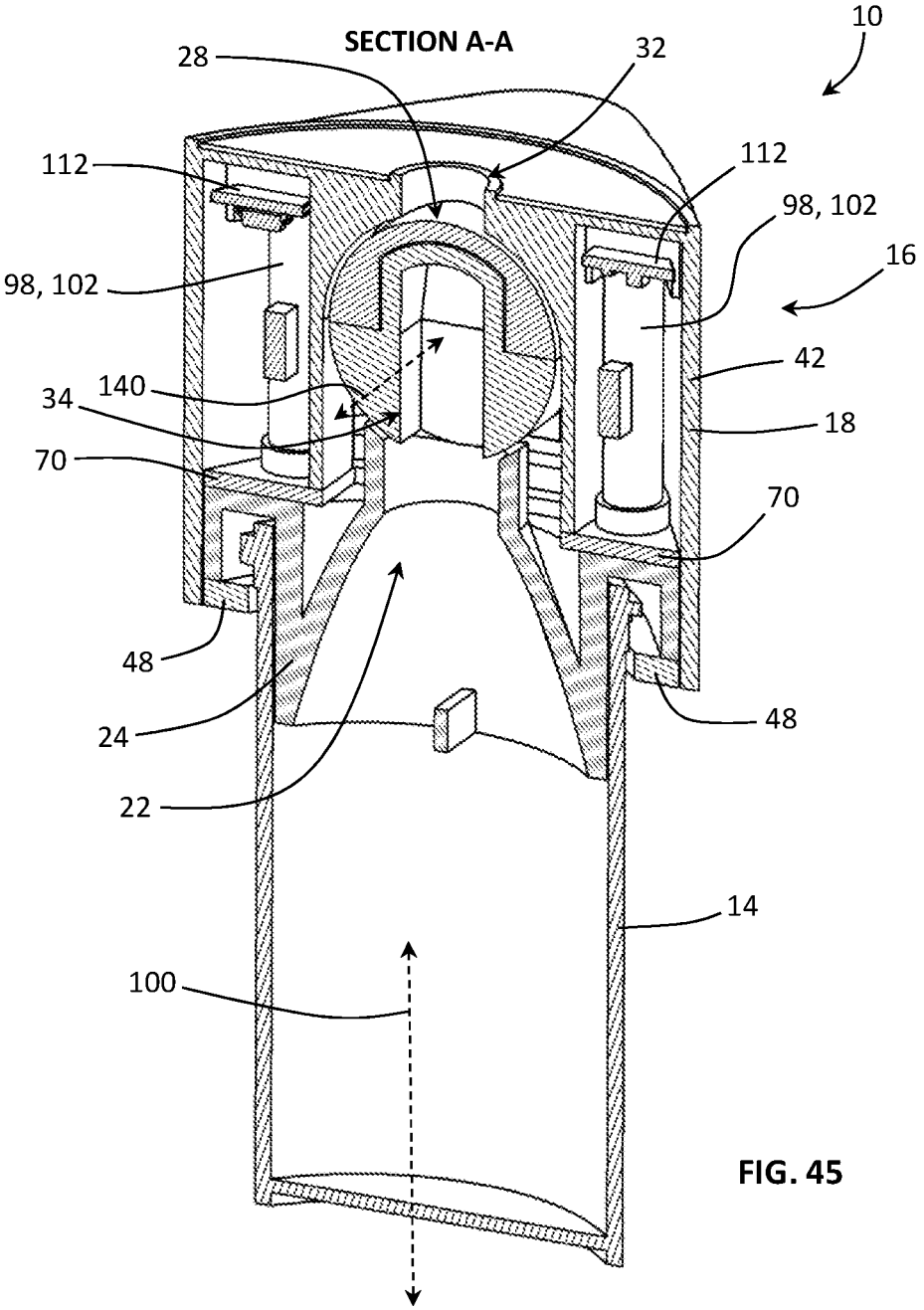
FIG. 45 is a cross-sectional perspective view of the system of FIG. 37 with the chute in the load position (i.e., open only to the entrance aperture)
Figure 46:
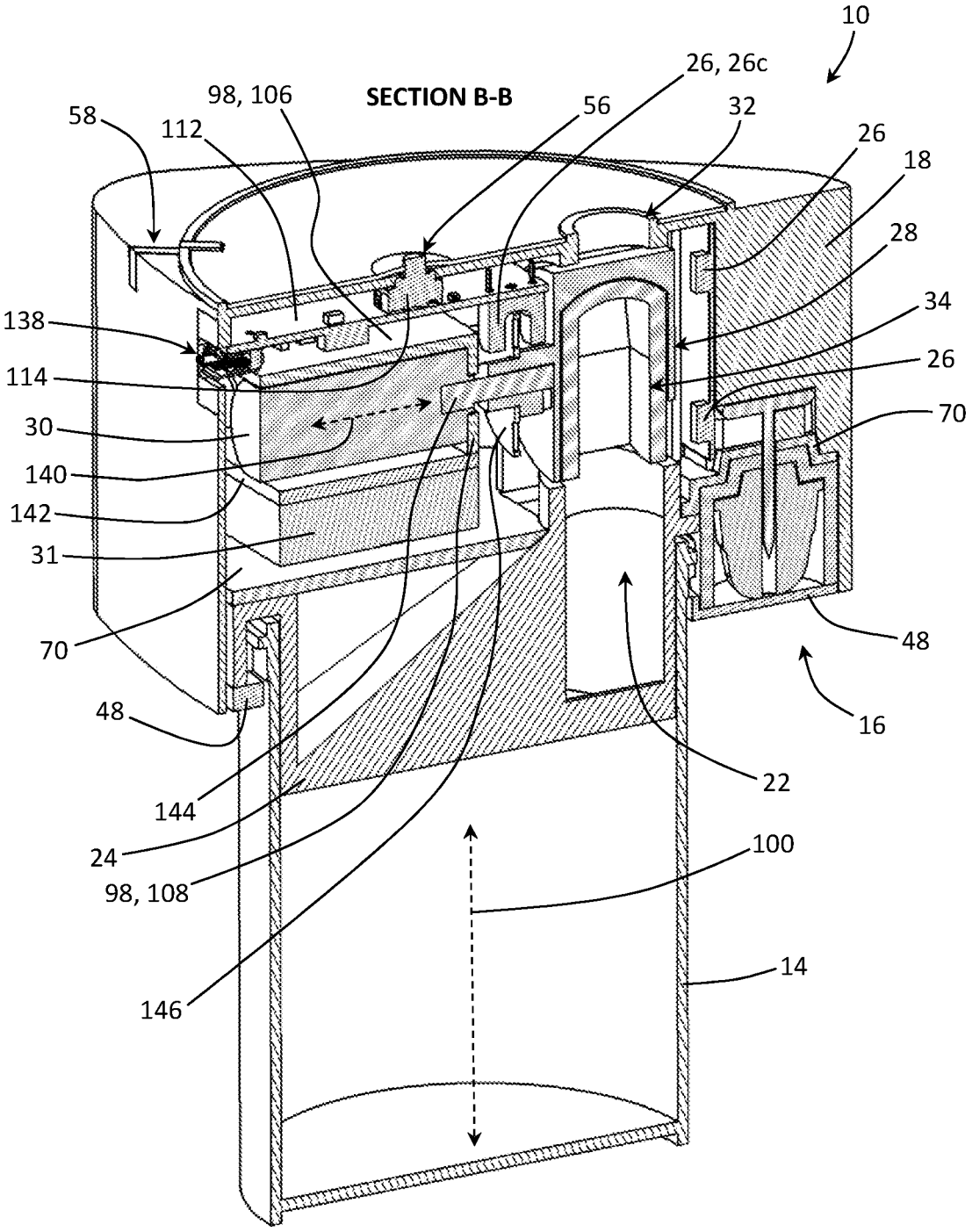
FIG. 46 is another cross-sectional perspective view of the system of FIG. 37 with the chute in the load position.
Figure 47:
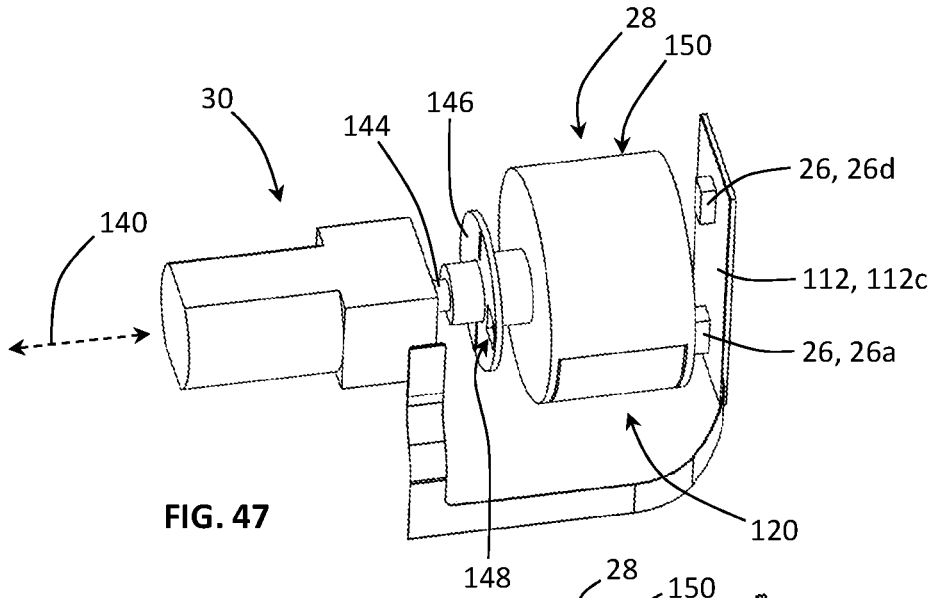
FIG. 47 is a perspective view of an actuator and transport portion of the system of FIG. 37 with the chute in the load position.
Figure 48:
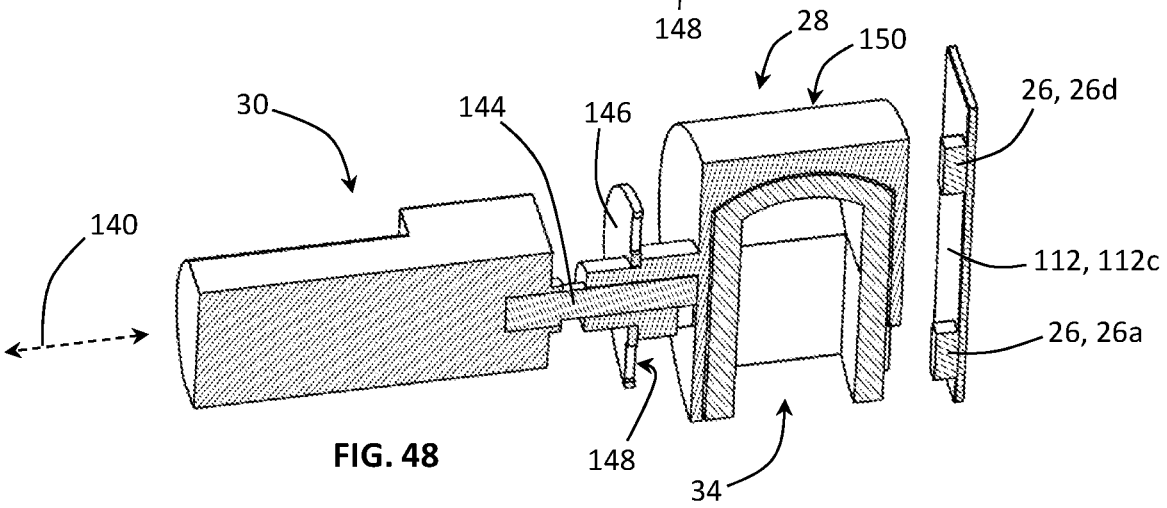
FIG. 48 is a cross-sectional perspective view of the actuator and transport portion of FIG. 47 with the chute in the load position.
Figure 49:
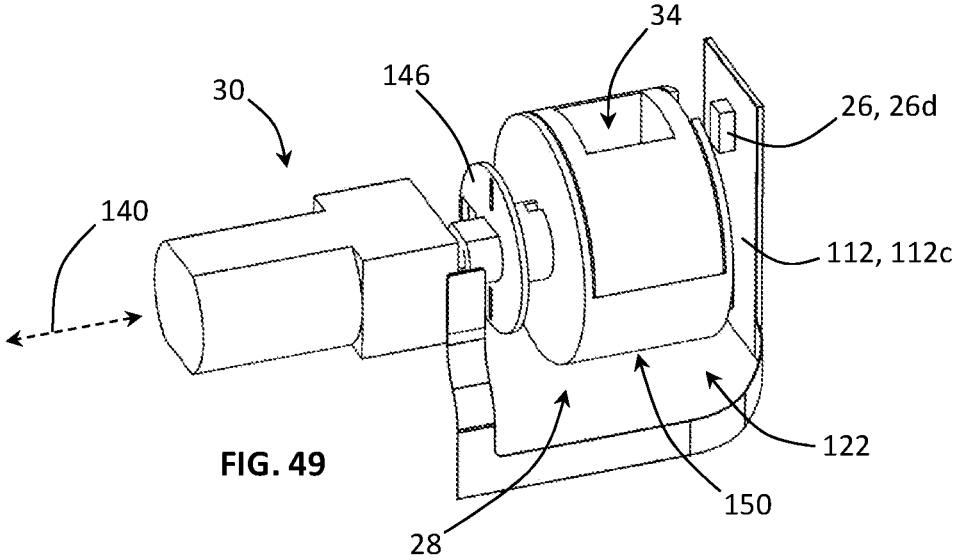
FIG. 49 is a perspective view of the actuator and transport portion of FIG. 47 with the chute in the unload position.
Figure 50:
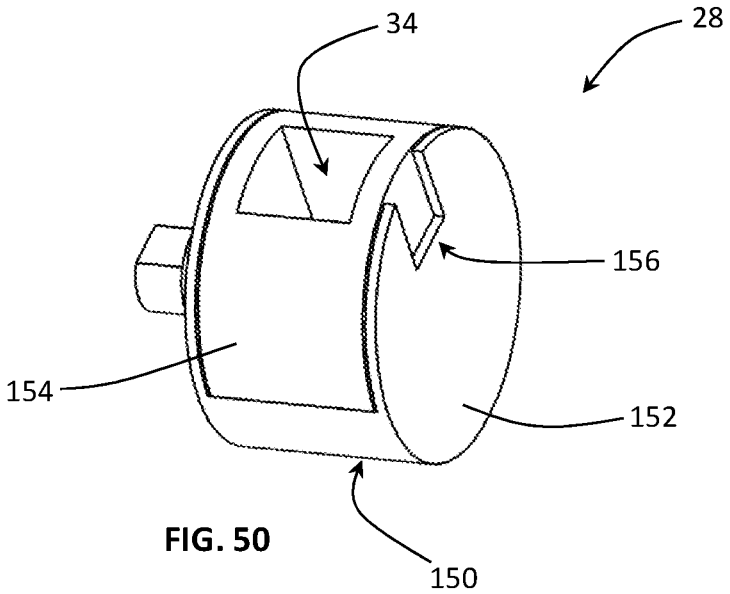
FIG. 50 is a perspective view of the transport portion of FIG. 47.
Figure 51:
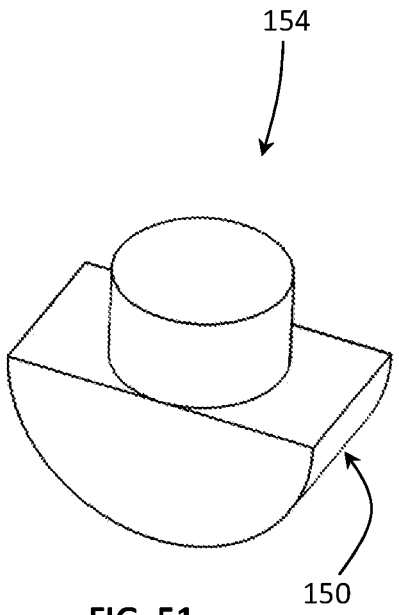
FIG. 51 is a perspective view of an removable insert of the transport portion of FIG. 47.
Figure 52:
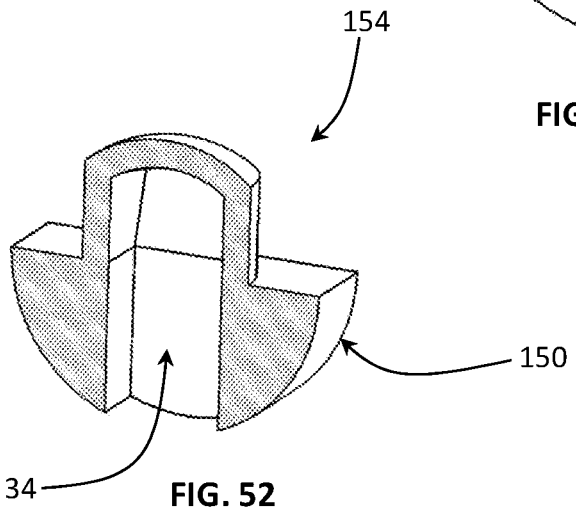
FIG. 52 is a cross-sectional perspective view of the removable insert of the transport portion of FIG. 47.

Referring to FIGS. 33 and 34, a transport portion 28 may have selected apertures extending therethrough. For example, a transport portion 28 may have a shaft aperture 134 and one or more range-of-motion apertures 136 or the like or combinations thereof extending therethrough.

A shaft aperture 134 may provide a location for a shaft of an actuator 30 (e.g., a shaft of an electric motor) to engage a transport portion 28. In selected embodiments, a shaft aperture 134 may be keyed, include a flat surface, or the like in order to resist relative rotation with respect to a shaft of an actuator 30. Accordingly, a shaft aperture 134 (or selected bonding agents applied to a shaft aperture 134) may ensure that a transport portion 28 rotates or pivots with the shaft of an actuator 30.

A range-of-motion aperture 136 may enable posts 102 of an interface 98 to extend through a transport portion 28 to engage or support an inner cover 24. A range-of-motion aperture 136 may be elongated and curved in order to support a desired relative rotation of the posts 102 of an interface 98 with respect the transport portion 28.

In selected embodiments, abutment of a post 102 with an end of a corresponding range-of-motion aperture 136 may define an end or extreme of a range of motion of a transport portion 28 with respect to the outer and inner covers 18, 24 of a cap 16. That is, abutment of a post 102 with one end of a corresponding range-of-motion aperture 136 may correspond to a loading position 120 and abutment of the post 102 with the other end of the corresponding range-of-motion aperture 136 may correspond to an unloading position 122.

In certain embodiments, abutment of a post 102 with an end of a corresponding range-of-motion aperture 136 may trigger a control system to stop rotating a transport portion 28. For example, abutment of a post 102 with an end of a corresponding range-of-motion aperture 136 may trigger a spike in the current draw of an actuator 30 urging rotation of the transport portion 28. Accordingly, a control system may detect the spike in current draw and cut off the flow of electrical power to the actuator 30. Thus, abutment of a post 102 with an end of a corresponding range-of-motion aperture 136 may function as a limit switch on the motion of a transport portion 28.

Referring to FIGS. 37-46, in selected embodiments, an outer cover 18 of a cap 16 may include an electrical port 138 (e.g., a micro USB port, a USB type-C port, or the like). An electrical port 138 may provide a mechanism for connecting a system 10 to electrical power. Accordingly, in selected embodiments, electrical power received through an electrical port 138 may be used to recharge one or more batteries 31 or other energy storage devices contained within a system 10. In certain embodiments, an electrical port 138 may provide power for a system 10 to function (i.e., power to dispense medication 12) at the same time as it is providing power to charge one or more batteries 31 or other energy storage devices contained within the system 10. Alternatively, or in addition thereto, an electrical port 138 may provide a mechanism for transporting data to or from a system 10. For example, an electrical port 138 may be used to pass data defining a prescribed schedule for dispensing medication to a system 10, pass data defining how the system 10 was used (or misused) to one or more external devices (e.g., one or more computers corresponding to a pharmacist or medical professional), or the like.

In certain embodiments, an entrance gate 22 or aperture 22 in an inner cover 24 may be axially aligned with an exit aperture 32 in an outer cover 18. For example, an entrance aperture 22 may be spaced from, but aligned in the axial direction 100 with, an exit aperture 32. In such embodiments, a transport portion 28 may be positioned between an entrance aperture 22 and an exit aperture 32 so as to block medication 12 from freely moving into the entrance aperture 22 and out of the exit aperture 32. In operation, a transport portion 28 so positioned may selectively rotate (e.g., rotate about an axis 140 that extends orthogonally with respect to the axial direction 100) between a first location (e.g., a load position) wherein a chute 34 is open only to the entrance aperture 22 and a second location (e.g., an unload position) wherein the chute 34 is open only to the exit aperture 32. Thus, a transport portion 28 may transport medication 12 from an entrance aperture 22 to an exit aperture 32 in a controlled manner.

In selected embodiments, an interface 98 may extend to connect and rotationally fix an outer cover 18 with respect to an upper locking ring 70. Fixing an interface 98 to an upper locking ring 70 rather than to an inner cover 24 may facilitate removal and replacement of the inner cover 24 in order to accommodate medication (e.g., pills, capsules, or the like) of a different size.

An interface 98 may space an outer cover 18 with respect to an upper locking ring 70 in an axial direction 100 to enable a transport portion 28 to rotate between the outer and inner covers 18, 24. In selected embodiments, an interface 98 may include one or more posts 102 that extend in the axial direction 100. The posts 102 may include apertures therewithin shaped and sized to receive threaded fasteners. On a lower end thereof, the posts 102 may contact and support an upper locking ring 70. On an upper end thereof, the posts 102 may contact and support a main body 42 of an outer cover 18. Accordingly, fasteners extending within the posts 102 may extend through and sandwich together an upper locking ring 70, an interface 98, a circuit board 112, and a main body 42.

In certain embodiments, an interface 98 may also provide a structure to which or within which one or more components of a control system may be mounted. For example, an interface 98 may include a surface against which a battery 31 may be secured (e.g., may include a surface enabling a piece of double sided adhesive tape 142 or the like to secure a battery 31 to the interface 98). Alternatively, or in addition thereto, an interface 98 may include an actuator housing 106 and/or an actuator mount 108. An actuator housing 106 may provide a location for an actuator 30 to reside. An actuator mount 108 may comprise a wall through which one or more apertures may extend. One or more fasteners (e.g., threaded fasteners) extending through the one or more apertures may secure the actuator 30 to the wall.

Referring to FIGS. 46-52, in selected embodiments, a shaft 144 may extend to connect an actuator 30 to a transport portion 28. Accordingly, rotational motion (e.g., rotation about an axis 140 that extends orthogonally with respect to the axial direction 100) applied by an actuator 30 to a shaft 144 may be transmitted by the shaft 144 to a transport portion 28. In certain embodiments, a disk 146 may be rotationally fixed with respect to a shaft 144, a transport portion 28, or the like. Accordingly, rotation of a shaft 144 and transport portion 28 may result in rotation of the disk 146. One or more apertures 148 extending through a disk 146 may have difference sizes and/or different locations. Accordingly, a sensor 26*c* (e.g., a through-beam optical sensor 26*c*) positioned near a disk 146 may detect when selected apertures 148 of selected sizes pass by or are in alignment with the sensor 26*c*. This may enable a control system corresponding to the sensor 26*c* to determine where a transport portion 28 is in its range of motion, when to stop rotation of an actuator 30 to position a chute 34 in a load position 120, when to stop of rotation of an actuator 30 to position a chute 34 in an unload position 122, and/or the like.

In selected embodiments, a transport portion 28 may include an outer, circumferential surface 150. A portion of the outer surface 150 may block medication 12 from exiting a container 14 via an entrance aperture 22 whenever a chute 34 is not aligned with the entrance aperture 22. Similarly, a portion of the outer surface 150 may block unwanted user access via the exit aperture 32 to the internals of a system 10 whenever a chute 34 is not aligned with the exit aperture 32.

In certain embodiments, a transport portion 28 or selected portions thereof may be formed of a transparent or semi transparent material (e.g., a transparent or semi transparent polymeric material). This may enable one or more sensors 26 (e.g., one or more optical sensors 26) mounted on a circuit board 112*c* to see when a tablet, capsule, or the like of medication 12 is loaded within a chute 34 of a transport portion 28.

For example, in operation, a transport portion 28 may selectively rotate between a first location (e.g., a load position 120) corresponding to a chute 34 being open only to an entrance aperture 22 and a second location (e.g., an unload position 122) corresponding to a chute 34 being open only to an exit aperture 32. A first sensor 26*a* may be positioned on a circuit board 112*c* so as to be proximate an open end of the chute 34 when the transport portion 28 is in the load position 120. Accordingly, the first sensor 26*a* may perceive through the transport portion 28 whether a tablet, capsule, or the like of the medication 12 is loaded within the chute 34. A second sensor 26*d* may be positioned on the circuit board 112*c* so as to be proximate an open end of the chute 34 when the transport portion 28 is in the unload position 122. Accordingly, the second sensor 26*d* may perceive through the transport portion 28 whether a tablet, capsule, or the like of the medication 12 is unloaded from within the chute 34.

Thus, in a dispensing operation, a user may press a button 56 (e.g., perform a single press of a button 56 or a particular sequence, pattern, and or rate of button presses that provide a child-safety lock) to communicate his or her desire to receive a dose of medication 12. If it is an appropriate time to dispense a dose of the medication 12, a feedback device 58 may so indicate and a system 10 may prepare to dispense medication 12. Accordingly, the user may invert the system 10 and gently shake it until a tablet, capsule, or the like passes through an entrance aperture 22 and into a chute 34 of the transport portion 28.

When the control system detects via the first sensor 26*a* that a tablet, capsule, or the like is loaded within the chute 34, the transport portion 28 may be rotated to the unload position 122. When the control system detects via the second sensor 26*d* that a tablet, capsule, or the like has exited the chute 34, the transport portion 28 may be rotated to the load position 120. Thus, the system 10 may be ready to dispense a subsequent dose of the medication 12 after an appropriate time interval has passed.

In selected embodiments, a transport portion 28 may comprise a base 152 and an insert 154. A base 152 may be connected to a shaft 144 and provide a location for receiving an insert 154. An insert 154 may define a shape and size of a chute 34. Accordingly, by removing one insert 154 from a base 152 and replacing it with another insert 154, a pharmacist, medical professional, or the like may configure a system 10 to handle a particular medication 12 (e.g., a medication 12 having a particular pill size).

In certain embodiments, both a base 152 and an insert 154 may be formed of a transparent or semi transparent material to enable one or more sensors 26*a*, 26*d* to see when a tablet, capsule, or the like of medication 12 is loaded within or exits a chute 34. Alternatively, a base 152 may be formed of an opaque material and an insert 154 may be formed of a transparent or semi transparent material. In such embodiments, a base 152 may have a window 156 or aperture 156 formed therein that may allow one or more sensors 26*a*, 26*d* to optically sense medication 12 within an insert 154.

Figure 53:
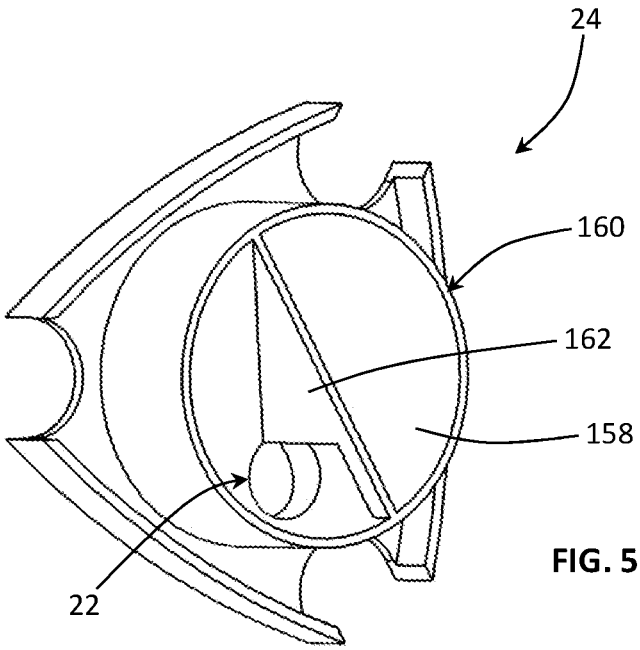
FIG. 53 is a perspective view of an inner cover of a cap of the system of FIG. 37.
Figure 54:
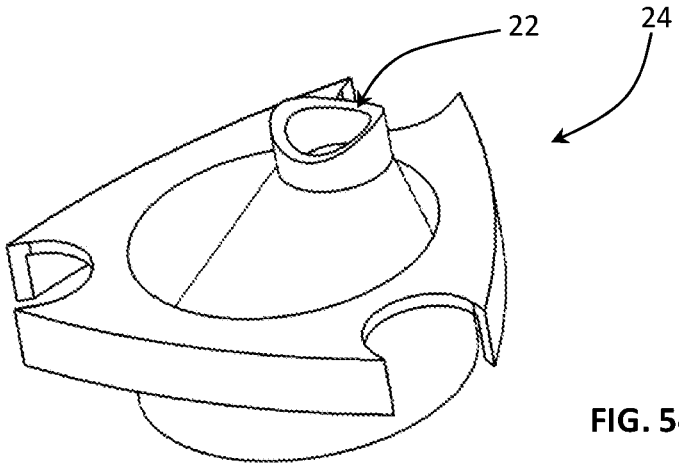
FIG. 54 is another perspective view of the inner cover of FIG. 53.

Referring to FIGS. 53 and 54, an inner cover 24 may define a shape and size of an entrance aperture 22. Accordingly, by removing one inner cover 24 and replacing it with another inner cover 24, a pharmacist, medical professional, or the like may configure a system 10 to handle a particular medication 12 (e.g., a medication 12 having a particular pill size).

In selected embodiments, an inner cover 24 may include a funnel 158 tapering down from a wide opening 160 or mouth 160 to a more narrow entrance aperture 22. When a system 10 is inverted, a funnel 158 may guide medication 12 from a container 14 to an entrance aperture 22. In certain embodiments, a funnel 158 may include a dividing wall 162. A dividing wall 162 may work to prevent medication 12 (e.g., a plurality of pills) from interlocking, jamming, binding, or otherwise clumping together. Accordingly, a dividing wall 162 may assisting in guiding medication 12 to the entrance aperture 22 in a easy, regular, and predictable manner.

Figure 55:
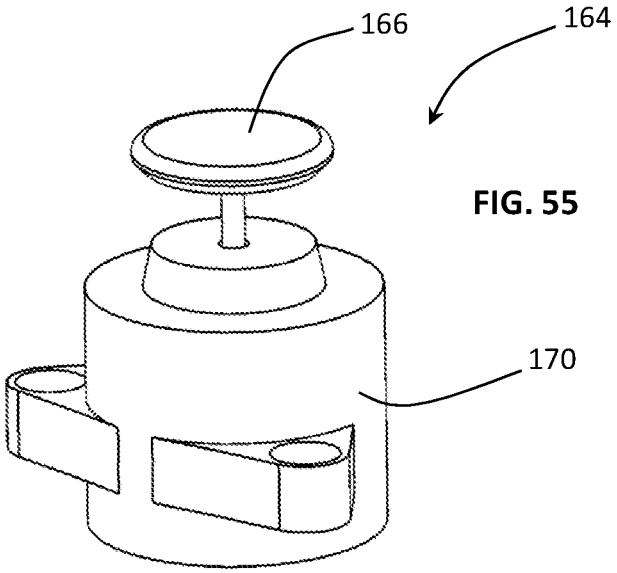
FIG. 55 is a perspective view of a pin and anchor assembly of the system of FIG. 37.
Figure 56:
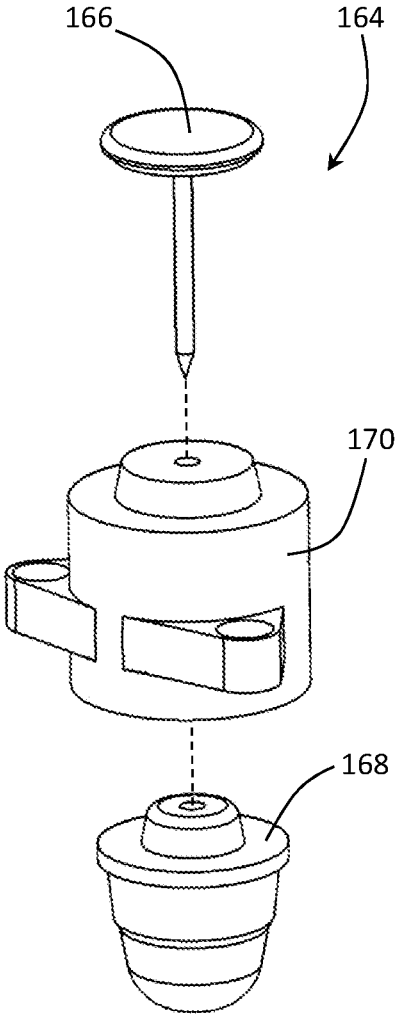
FIG. 56 is an exploded perspective view of the pin and anchor assembly of FIG. 55.

Referring to FIGS. 55 and 56, one or more securement mechanisms 164 may be used to secure a cap 16 to a container 14. In selected embodiments, a securement mechanism 164 may be or comprise a magnetically releasable engagement system (see e.g., U.S. Pat. No. 4,012,813, which is hereby incorporated by reference). For example, a securement mechanism 164 may include a pin 166, anchor 168, and anchor mount 170. When a pin 166 is inserted within an anchor 168, the anchor 168 may mechanically engage the pin 166 so as to resist removal of the pin 166 from the anchor 168. Only when a powerful magnet is applied to a back side of the anchor 168 (a side opposite the pin 166) may the mechanical engagement of the pin 166 be released so as to enable removal of the pin 166 from the anchor 168. An anchor mount 170 may support or enable securement of an anchor 168 to a desired component of a system (e.g., to a lower locking ring 48).

Figure 57:
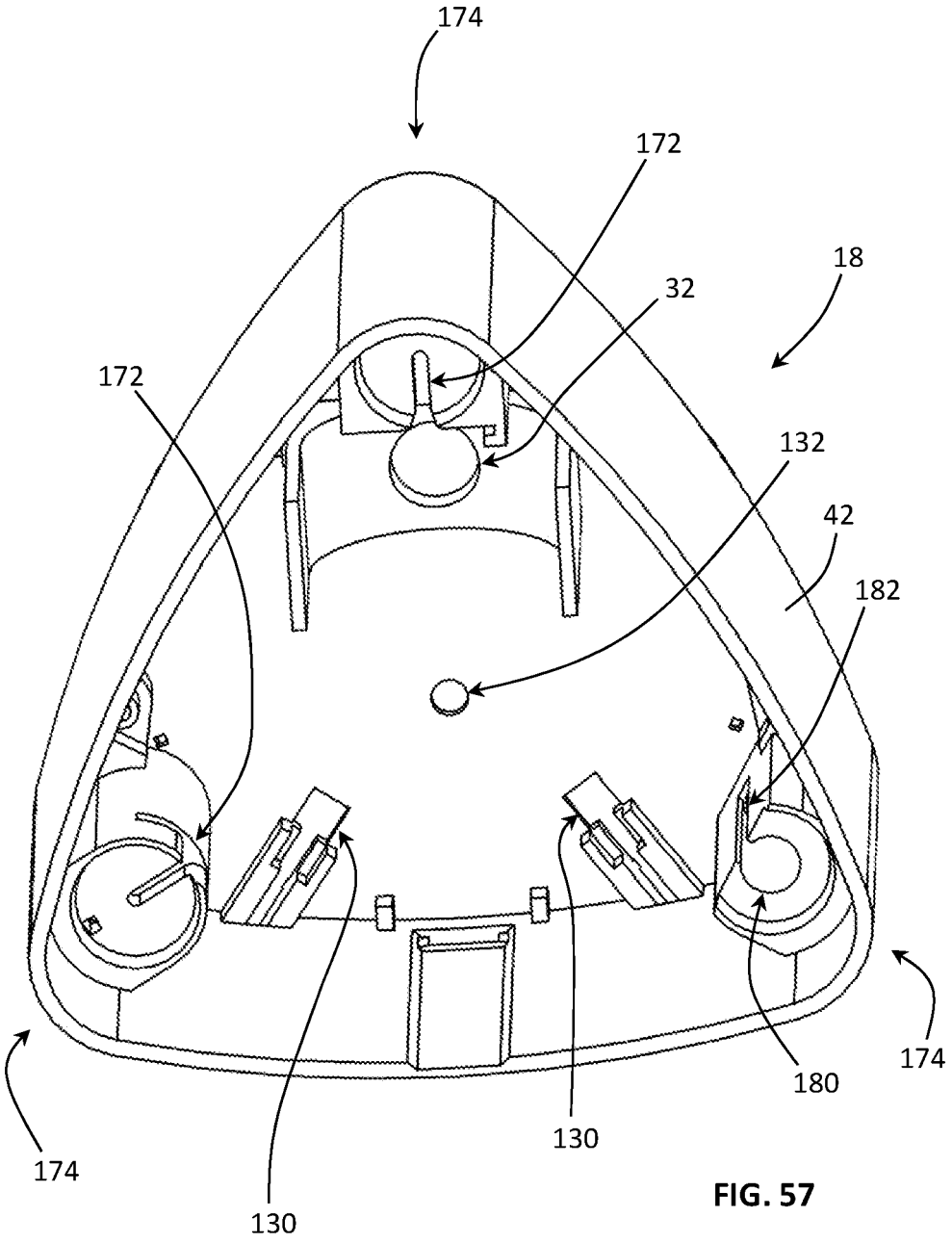
FIG. 57 is a perspective view of an interior of a main body of a cap of the system of FIG. 37.
Figure 58:
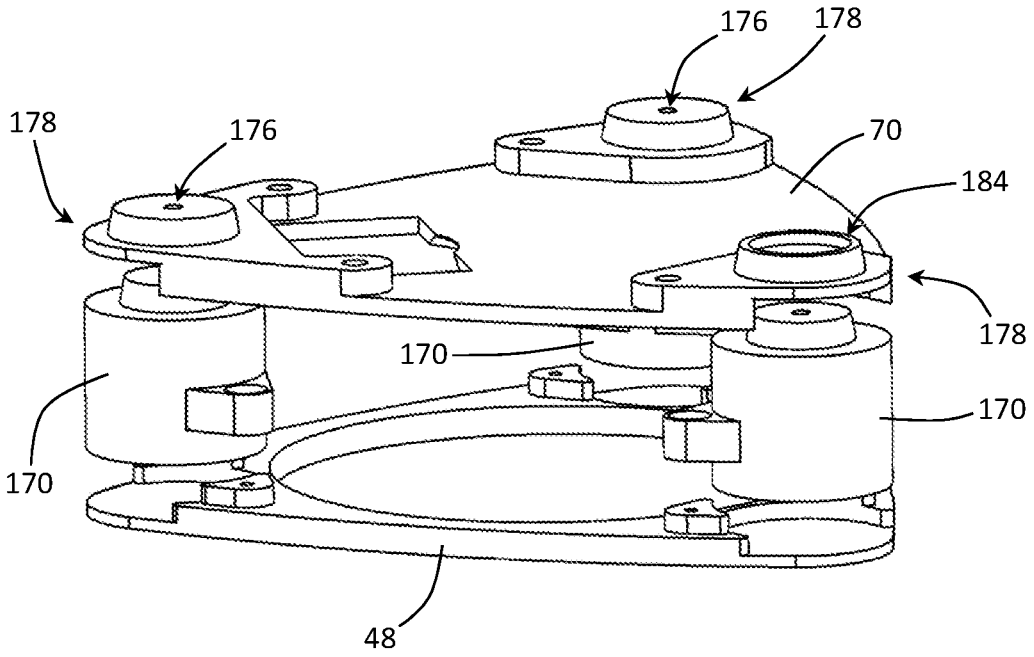
FIG. 58 is an exploded perspective view of an upper locking ring, a plurality of anchor mounts, and a lower locking ring of the system of FIG. 37.
Figure 59:
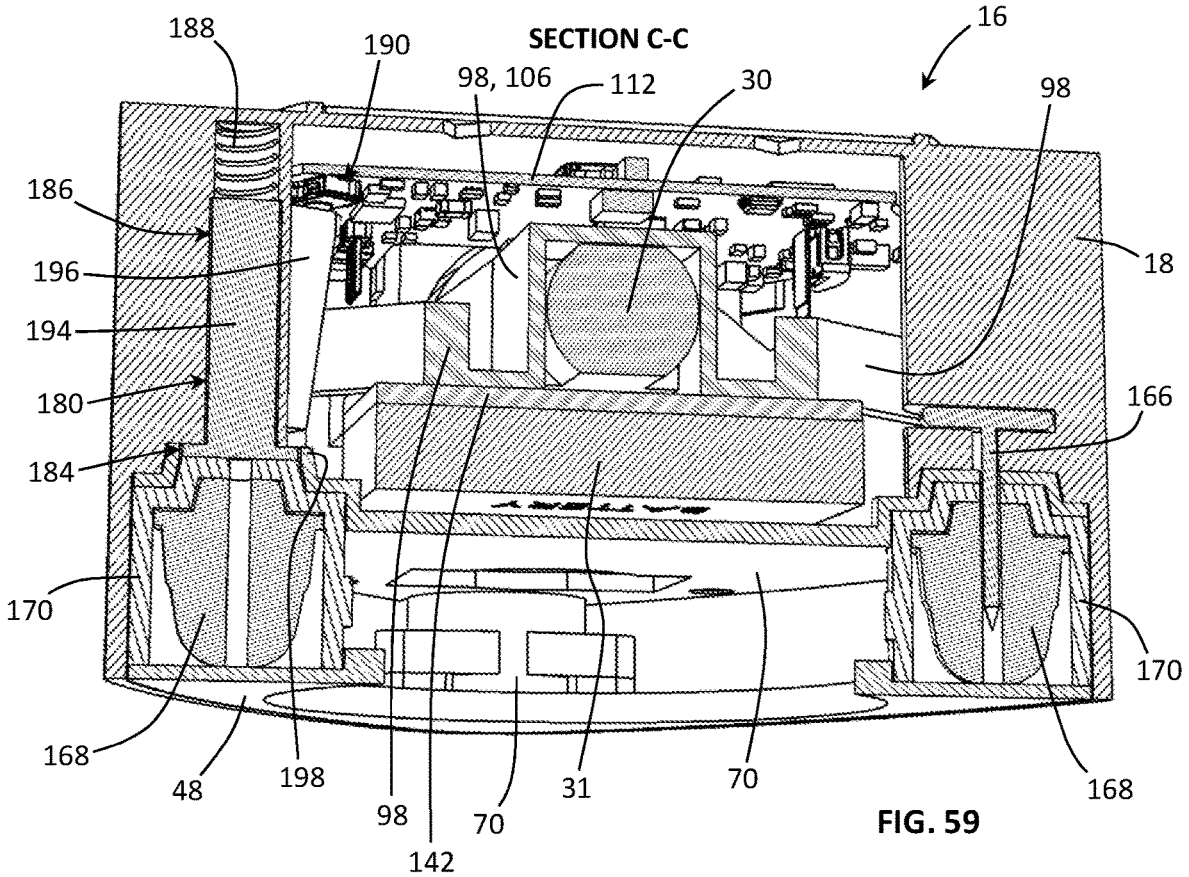
FIG. 59 is a cross-sectional perspective view of selected components of a cap of the system of FIG. 37.
Figure 60:
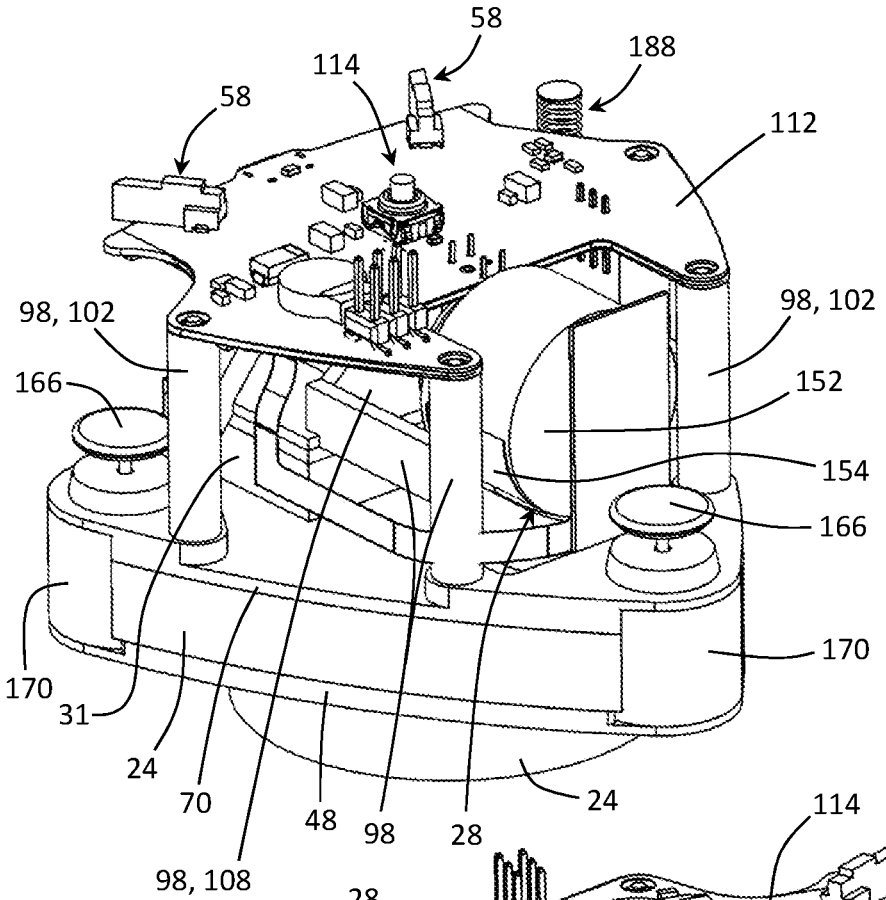
FIG. 60 is a perspective view of selected internal components of a cap of the system of FIG. 37.
Figure 61:
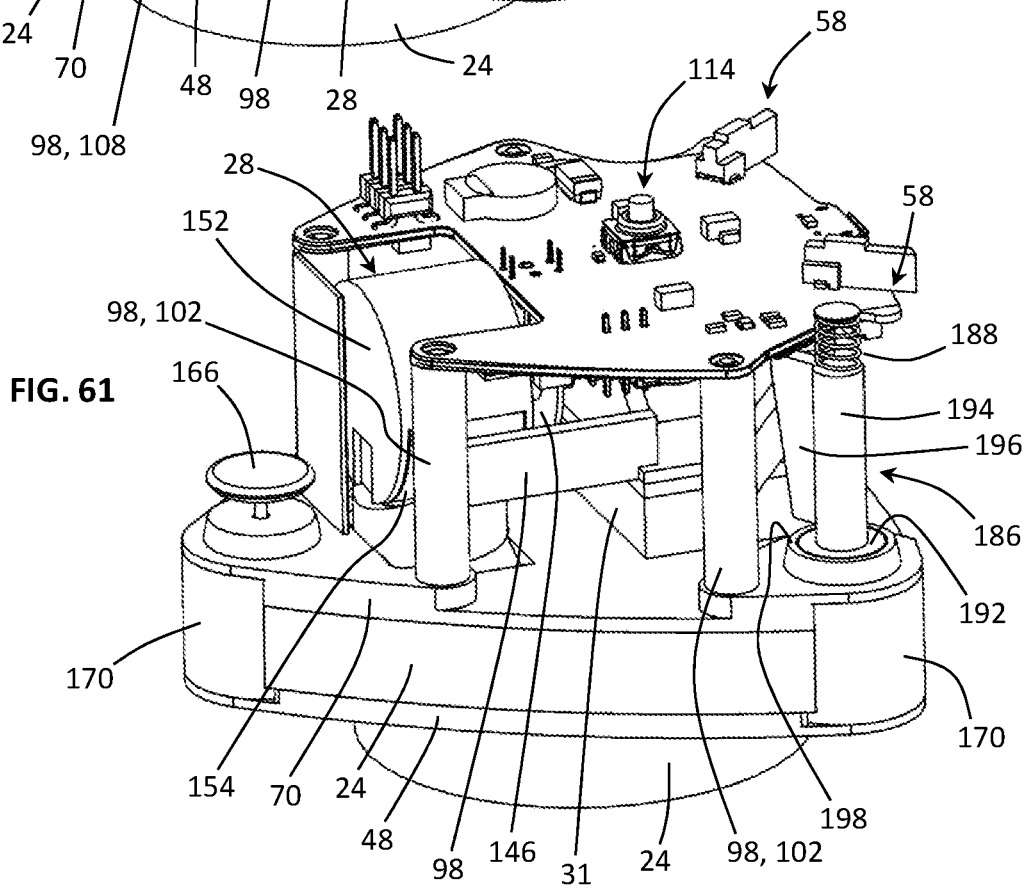
FIG. 61 is another perspective view of the internal components of FIG. 60.
Figure 62:
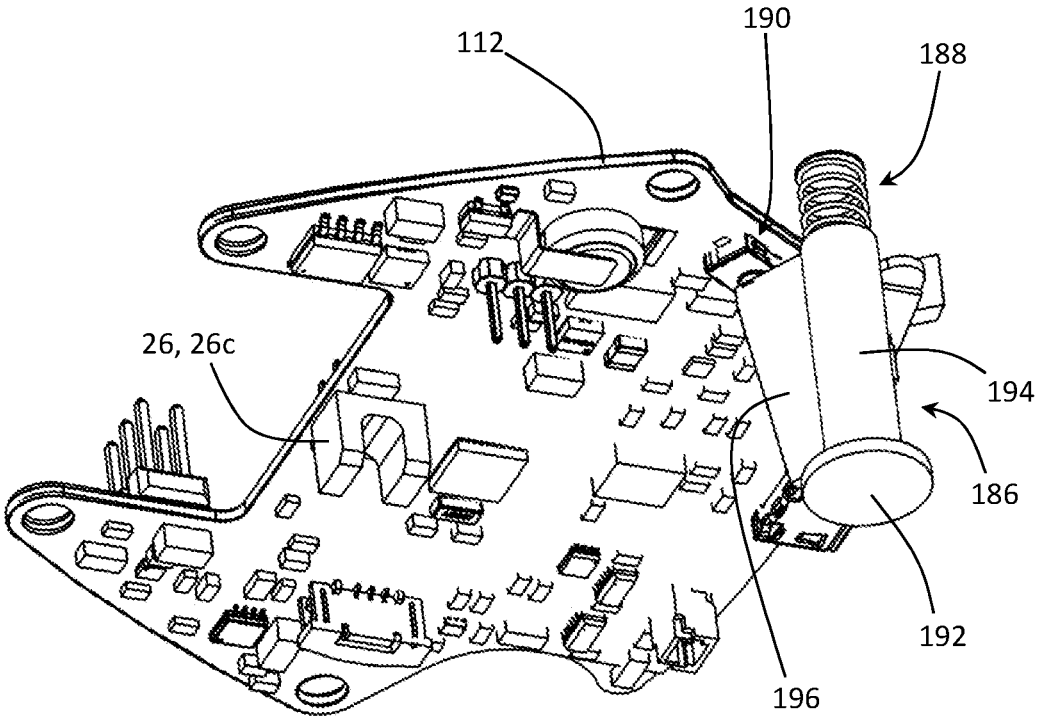
FIG. 62 is a perspective view of a circuit board and tamper detection system of the system of FIG. 37.

Referring to FIGS. 57-59, a head of a pin 166 may enable the pin 166 to secure to a main body 42 of a cap 16. In certain embodiments, a main body 42 may include one or more T-shaped slots 172 that may each receive a head of a corresponding pin 166 and secure the pin 166 against motion and loads in the axial direction 100. For example, a main body 42 may have three corners 174 formed therein. Interior to each of two such corners 174 may be a T-shape slot 172 for receiving a pin 166 therewithin. When assembled, two pins 166 may extend from respective T-shaped slots 172 and through respective pin aperture 176 in an upper locking ring 70. Accordingly, securement of an upper locking ring 70 to an interface 98, circuit board 112, and main body 42 may lock one or more pins 166 in place with the shafts thereof positioned to engage one or more anchors 168.

In selected embodiments, one or more anchor mounts 170 may be fastened to a lower locking ring 48. For example, a lower locking ring 48 may have three points 178 formed therein. Interior to each such point 178 may be an anchor mount 170 securing a corresponding anchor 168 to the lower locking ring 48. In certain embodiments, the number of anchors 168 and anchor mounts 170 in a system 10 may exceed the number of pins 166 in the system 10. Accordingly, in an engagement, one or more anchors 168 may be unused. For example, a system 10 may include two pins 166 and three anchors 168. Therefore, when the system 10 is assembled, one anchor 168 may be unused. In such embodiments, the space that would otherwise be occupied by a T-shaped slot 172 and pin 166 (e.g., a third T-shaped slot 172 and pin 166) may be occupied by one or more components of a tamper detection system.

In selected embodiments, a main body 42 may have an aperture 180 and slot 182 and an upper locking ring 70 may have an aperture 184 shaped and sized to accommodate a traveler 186 of a tamper detection system. Accordingly, when a system 10 is assembled, one anchor 168 and corresponding anchor mount 170 may abut a traveler 186 rather than engage a pin 166. In such embodiments, that anchor 168 and corresponding anchor mount 170 may be omitted. However, by including them, a lower locking ring 48 may be agnostic as to its alignment with a main body 42. That is, it does not matter to a lower locking ring 48 (and hence to a user assembling the system 10) which anchor 168 and corresponding anchor mount 170 aligns with which pin 166 and/or traveler 186. Each anchor 168 and corresponding anchor mount 170 secured to a lower locking ring 48 may function equally well in each position. Thus, a user assembly a system 10 (e.g., a pharmacist reconnecting a cap 16 to a container 14 after having filled a prescription) need not concern himself or herself with finding a particular or unique alignment of a lower locking ring 48.

Referring to FIGS. 59-62, in selected embodiments, a tamper detection system may comprise a traveler 186, biasing member 188, switch 190, memory (e.g., non-volatile memory), auxiliary power, or the like or a combination or sub-combination thereof. A traveler 186 may include a head 192, body 194, and extension 196. A head 192 of a traveler 186 may be positioned within an aperture 184 of an upper locking ring 70 and contact an adjacent anchor mount 170. A body 194 of a traveler 186 may be positioned within an aperture 180 of a main body 42 extending from a head 192 of the traveler 186 to a biasing member 188. An extension 196 of a traveler 186 may extend from a body 194, through a slot 182 in the main body 42, to contact a switch 190.

In operation, when a system 10 is fully assembled, an adjacent anchor mount 170 may oppose a biasing member 188 and hold a traveler 186 so that an extension 196 thereof depresses a switch 190. However, when the system 10 is disassembled, the anchor mount 170 may be removed and no longer contact the head 192 of the traveler 186. Accordingly, the biasing member 188 may move the traveler 186 so that the extension 196 thereof releases the switch 190. In selected embodiments, the biasing member 188 may move the traveler 186 until the extension 196 contacts a lip 198 defining an aperture 184 in the upper locking ring 70.

When a switch 190 is released and/or depressed, that event may be recorded in memory. Accordingly, when a pharmacist, medical professional, or the like accesses the data stored in memory, he or she may see if and/or when a cap 16 was separated from a container 14. This may enable the pharmacist, medical professional, or the like to determine whether the system 10 has been tampered with or used in an unauthorized manner.

In selected embodiments, a tamper detection system may comprise auxiliary power that enables switch activity to be monitored and recorded in memory (e.g., non-volatile memory) for an extended period of time and/or after other power storage devices (e.g., a main battery 31) are fully drained of their electrical power. The power necessary to monitor and record switch activity may be minimal. Accordingly, in certain embodiments, an appropriately sized super capacitor may be a suitable source of auxiliary power. A super capacitor may be charged at the same time as a battery 31, yet be electrically isolated so that it is not affected when the electrical power stored within the battery 31 is consumed. Accordingly, a misuser of a system 10 may not drain a battery 31 and then separate the cap 16 from the container 14 without that separation being recorded in memory.

Figure 63:
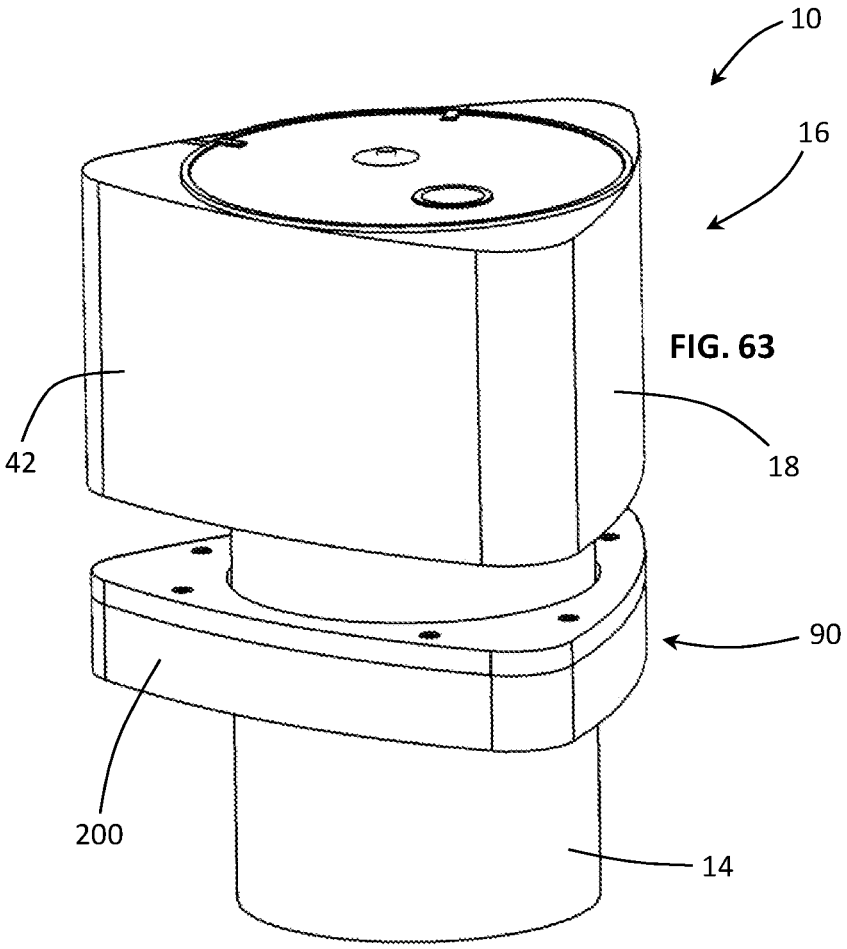
FIG. 63 is a perspective view of the system of FIG. 37 with a unlocking tool applied thereto.
Figure 64:
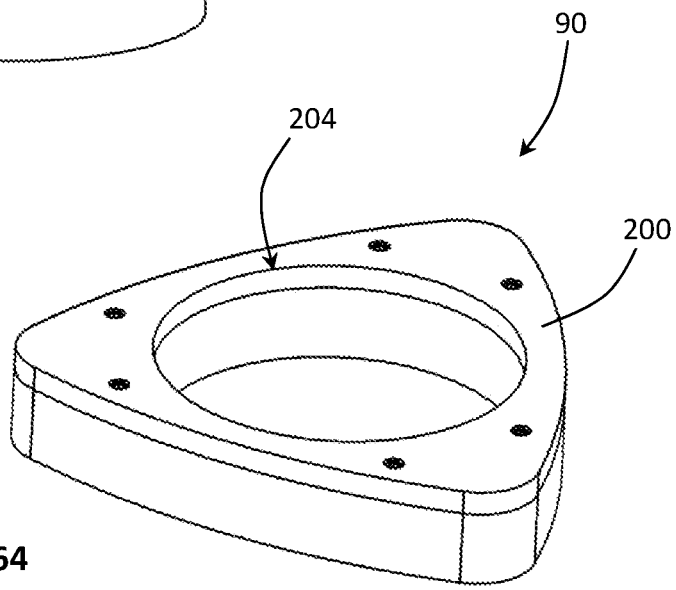
FIG. 64 is a perspective view of the unlocking tool of FIG. 63.
Figure 65:
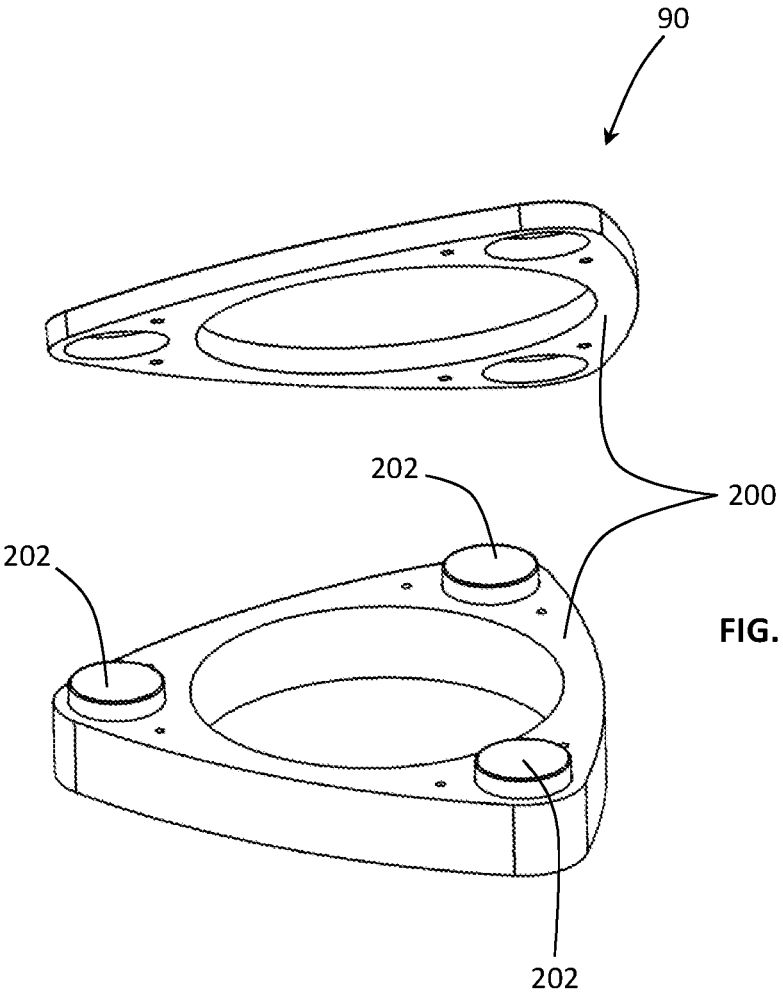
FIG. 65 is an exploded perspective view of the unlocking tool of FIG. 63.

Referring to FIGS. 63-65, in selected embodiments, an unlocking tool 90 may comprise a housing 200 and one or more magnets 202 (e.g., high strength magnets not typically found in a domestic or work setting). A housing 200 may have an interior aperture 204 enabling the unlocking tool 90 to pass over a container 14 to abut an underside of a cap 16. An unlocking tool 90 may have a perimeter shape that matches the perimeter shape of an exterior portion 18 of a cap 16. By aligning the perimeter of an unlocking tool 90 with the perimeter of an exterior portion 18 of a cap 18, a user may properly position one or more magnets 202 below one or more anchors 168 so as to disengage those anchors 168 from any pins 166 positioned therewithin.

Accordingly, when an unlocking tool 90 is abutted against and in alignment with an underside of a cap 16, a user may pull a container 14 away from the cap 16. This may pull a lower locking ring 48 and the anchors 166 secured thereto away from the rest of the cap 16. An inner cover 24 may remain in place with respect to a main body 42, but may not be held there with any fasteners. Accordingly, when a system 10 is opened using an unlocking tool 90, an inner cover 24 may be removed and replaced as desired.

Removal of an inner cover 24 may provide access to an insert 154 of a transport portion 28. Accordingly, when a system 10 is opened using an unlocking tool 90 and an inner cover 24 is removed, an insert 154 of a transport portion 28 may be removed and replaced as desired.

After medication 12 has been placed within a container 14, a system 12 may be reassembled by inserting an appropriate insert 154 within a base 152 of the transport portion 28, inserting an appropriate inner cover 24 within the main body 42, applying the container 14 to the main portion of the cap 16, sliding a lower locking ring 48 and the anchors 168 secured thereto over the container 14, and fully seating the lower locking ring 48 within the main body 42.

References in the specification to "one embodiment," "an embodiment," "an example embodiment," "selected embodiments," "certain embodiments," etc., indicate that the embodiment or embodiments described may include a particular feature, structure, or characteristic, but every embodiment may not necessarily include the particular feature, structure, or characteristic. Such phrases are not necessarily referring to the same embodiment.

In selected figures discussed hereinabove, certain components (e.g., the actuator 30, anchor 168, various circuit boards 112, various components mounted to circuit boards, etc.) are shown in cross-section as being homogeneously solid or mostly solid structures. In actuality, such components may have whatever internal components are necessary to perform their intended function. For example, one possible embodiment of what the internal components of an anchor 168 may be is provided within U.S. Pat. No. 4,012,813, which is referenced and incorporated above. Accordingly, reproducing drawings of those internal components in the present disclosure is not necessary for a proper understanding of the present invention.

The present invention may be embodied in other specific forms without departing from its spirit or essential characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. A medication-dispensing system comprising:
a prescription vial comprising an opening; and
a cap closing off the opening and comprising
an outer cover comprising an exit aperture,
an inner cover comprising an entrance aperture,
a transport portion positioned between the outer cover and the inner cover and comprising a chute, the chute comprising an open end and a closed end opposite the open end, and
a control system comprising a processor electrically controlling rotation of the transport portion between a load position and an unload position, wherein the load position comprises the open end of the chute being adjacent and opening to the entrance aperture and the unload position comprises the open end of the chute being adjacent and opening to the exit aperture.

2. The medication-dispensing system of claim 1, wherein:
the prescription vial has a height defining an axial direction;
the inner cover is rotationally fixed with respect to the outer cover; and
the control system selectively rotates the transport portion with respect to the inner and outer covers about an axis that extends perpendicularly with respect to the axial direction.

3. The medication-dispensing system of claim 2, wherein the control system further comprises an electric motor positioned and connected to selectively induce rotation of transport portion with respect to the inner and outer covers.

4. The medication-dispensing system of claim 3, wherein the control system further comprises at least one first sensor positioned proximate the chute when the transport portion is in the load position.

5. The medication-dispensing system of claim 4, wherein the control system further comprises at least one second sensor positioned proximate the chute when the transport portion is in the unload position.

6. The medication-dispensing system of claim 5, wherein the transport portion comprises a base and an insert, the insert being selectively removable from the base and comprising the chute.

7. The medication-dispensing system of claim 1, wherein the control system further comprises a tamper detection system, the tamper detection system comprising a switch, a traveler, and a biasing member, the traveler pressing the switch when the cap is secured to the prescription vial, the biasing member moving the traveler so as to release the switch when the cap is unsecured to the prescription vial.

8. The medication-dispensing system of claim 7, wherein the control system further comprises:
an electric motor positioned and connected to selectively induce rotation of the transport portion with respect to the inner and outer covers; and
a battery providing electrical power to the electric motor.

9. The medication-dispensing system of claim 8, wherein the tamper detection system further comprises computer memory and an auxiliary power source, the auxiliary power source being isolated from the battery so that draining electrical power from the battery does not drain electrical power from the auxiliary power.

10. The medication-system of claim 9, wherein the tamper detection system uses electrical power stored within the auxiliary power source to record to the computer memory changes in the state of the switch.

11. A medication-dispensing system comprising a prescription vial comprising one open end;

a cap closing off the one open end;

the cap comprising an outer cover including an exit aperture, an inner cover including an entrance aperture, and a transport portion including a chute;

the cap wherein the inner cover is fixed with respect to the outer cover;

the cap wherein the transport portion is positioned between the outer cover and the inner cover;

a control system comprising a processor;

the control system controlling movement of the transport portion with respect to the outer and inner covers; and the control system further comprising a tamper detection system comprising a switch, a traveler, and a biasing member, the traveler pressing the switch when the cap is secured to the prescription vial, the biasing member moving the traveler so as to release the switch when the cap is unsecured to the prescription vial.

12. The medication-dispensing; system of claim 11, further comprising one or more magnetically releasable engagement systems selectively securing the cap to the prescription vial.

13. The medication-dispensing system of claim 11, wherein the control system further comprises:

an electric motor positioned and connected to selectively induce rotation of the transport portion with respect to the inner and outer covers; and a battery providing electrical power to the electric motor.

14. The medication-dispensing system of claim 13, wherein the tamper detection system further comprises computer memory and an auxiliary power source, the auxiliary power source being isolated from the battery so that draining electrical power from the battery does not drain electrical power from the auxiliary power source.

15. The medication-dispensing system of claim 14, wherein the tamper detection system uses electrical power stored within the auxiliary power source to record to the computer memory changes in the state of the switch.

16. The medication-dispensing system of claim 11, wherein the chute has an open end and a closed end opposite the open end.

17. The medication-dispensing system of claim 16, wherein the control system controls rotation of the transport portion between a load position wherein the chute is open only to the entrance aperture and an unload position wherein the chute is open only to the exit aperture.

18. The medication-dispensing system of claim 11, wherein:

the prescription vial has a height defining an axial direction; and the control system selectively rotates the transport portion with respect to the inner and outer covers about an axis that extends perpendicularly with respect to the axial direction.

19. The medication-dispensing system of claim 18, wherein the transport portion comprises a base and an insert, the insert being selectively removable from the base and comprising the chute.

20. The medication-dispensing system of claim 19, wherein the control system further comprises:

an electric motor;

a shaft extending to transfer rotation generated by the electrical motor to the base of the transport portion; and a battery providing electrical power to the electric motor.

* * * * *